US012129727B2

(12) United States Patent
Andueza et al.

(10) Patent No.: US 12,129,727 B2
(45) Date of Patent: Oct. 29, 2024

(54) COLLET-TYPE WELLHEAD CONNECTOR SYSTEM

(71) Applicant: FMC Technologies, Inc., Houston, TX (US)

(72) Inventors: Alejandro Andueza, Rio de Janeiro (BR); Barry Stewart, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 255 days.

(21) Appl. No.: 17/755,656

(22) PCT Filed: Nov. 6, 2019

(86) PCT No.: PCT/US2019/060122

§ 371 (c)(1),
(2) Date: May 4, 2022

(87) PCT Pub. No.: WO2021/091555

PCT Pub. Date: May 14, 2021

(65) Prior Publication Data

US 2022/0356776 A1 Nov. 10, 2022

(51) Int. Cl.
*E21B 33/038* (2006.01)

(52) U.S. Cl.
CPC ..... *E21B 33/038* (2013.01)

(58) Field of Classification Search
CPC ..... E21B 33/038; E21B 17/046
See application file for complete search history.

(56) References Cited

U.S. PATENT DOCUMENTS 4,491,346 A * 1/1985 Walker ..... E21B 33/038
4,496,172 A * 1/1985 Walker ..... E21B 33/038
4,984,830 A * 1/1991 Saunders ..... E21B 33/038
6,035,938 A * 3/2000 Watkins ..... E21B 33/038
(Continued)

FOREIGN PATENT DOCUMENTS

WO 2018191803 A1 10/2018
WO 2019104401 A1 6/2019

OTHER PUBLICATIONS

International Search Report issued in International Application No. PCT/US2019/060122 dated Jul. 13, 2020 (4 pages).
(Continued)

*Primary Examiner* — Zachary T Dragicevich
(74) *Attorney, Agent, or Firm* — Osha Bergman Watanabe & Burton LLP

(57) ABSTRACT

A connecting assembly for connecting a first body and a second body. The first body includes multiple grooves formed on an outside of the first body near a connecting end. The connecting assembly includes a connector. The connector includes multiple connecting segments arranged circumferentially around a central longitudinal axis; and a first jaw formed on an inside of the segments. The first jaw includes multiple teeth. Each tooth includes: a leading side facing an axial center of the connector; a top side; and a trailing side opposite the leading side. A tooth height is measured between a base of the tooth and an intersection between the leading side and the top side of the tooth. At least two of the tooth/groove pairs have a difference between tooth height and groove depth that are different from each other.

18 Claims, 18 Drawing Sheets

(56) References Cited

U.S. PATENT DOCUMENTS

| | | | | |
|---|---|---|---|---|
| 9,334,705 | B1 | 5/2016 | Ward et al. | |
| 10,041,618 | B2 * | 8/2018 | Nguyen | E21B 17/043 |
| 2002/0176748 | A1 * | 11/2002 | Carter | E21B 33/038 |
| 2004/0102069 | A1 * | 5/2004 | Singeetham | E21B 33/038 |
| 2004/0113426 | A1 * | 6/2004 | Milberger | E21B 33/038 |
| 2005/0001427 | A1 * | 1/2005 | Liew | E21B 33/038 |
| 2007/0227983 | A1 | 10/2007 | Bryson et al. | |
| 2014/0318809 | A1 | 10/2014 | Joensen et al. | |
| 2015/0083430 | A1 * | 3/2015 | Jahnke | E21B 33/038 |
| 2016/0123103 | A1 * | 5/2016 | Puccio | E21B 33/038 |
| 2019/0085650 | A1 | 3/2019 | Andueza | |

OTHER PUBLICATIONS

Written Opinion issued in International Application No. PCT/US2019/060122 dated Jul. 13, 2020 (6 pages).

* cited by examiner

COLLET-TYPE WELLHEAD CONNECTOR SYSTEM

BACKGROUND

Field of the Disclosure

The present invention relates to a connector which features teeth that efficiently transfers the load.

Background Art

Subsea hydraulic connectors may be used to make a rigid and sealed connection between two pieces of equipment. Such connectors are commonly used in the area of oil and gas, for interfacing of Christmas Trees (XTs), Lower Riser Packages (LRPs), Tubing Heads (THs) and Wellheads (WHDs).

Subsea hydraulic connectors may be locked by driving a hydraulic piston around connecting segments, which engage with locking profiles in the equipment being connected. For example, a hydraulic connector may include an annular main body that is aligned and connected axially to a subsea wellhead. To form the connection, the connector typically has multiple connecting segments that move radially when a hydraulic actuator, often a hydraulically-driven piston, moves axially along the length of the connecting segments. This radial movement of the segments puts the connector in a locked or an unlocked position.

Subsea connectors used to connect two mating components may include a gasket between the components to form a gas or liquid tight seal. The connectors introduce a preload into the connection by using hydraulic pressure to drive the connecting segments into a mating locking profile on the components being connected. This preload may energize the gasket to provide high contact stresses between sealing profiles to resist fluid or gas penetration.

The earliest wellhead connectors consisted of a clamp, generally in a "C" shape, with a single contact surface. U.S. Pat. No. 3,096,999 describes a connector with a single contact surface profile.

Later, connectors with multiple teeth were designed to better distribute the stress when compared to ones with a single surface. U.S. Pat. No. 7,614,453 depicts a connector with a multi-tooth profile where the load is distributed through the profile, resulting in better reliability of the connection and lower wear on the connector.

SUMMARY

One or more embodiments include a connecting assembly for connecting a first body and a second body. The first body includes a plurality of grooves formed on an outside of the first body near a connecting end. The connecting assembly includes a connector. The connector includes a plurality of connecting segments arranged circumferentially around a central longitudinal axis; and a first jaw formed on an inside of the segments. The first jaw includes a plurality of teeth. Each tooth includes: a leading side facing an axial center of the connector; a top side; and a trailing side opposite the leading side. A tooth height is measured between a base of the tooth and an intersection between the leading side and the top side of the tooth. Each groove includes: a front side closest to the connecting end; a back side opposite the front side; a base side extending between the front side and the back side; and an outer side extending between adjacent grooves. A groove depth is measured between a line tangent to the outer side and an intersection between the front side and the base side of the groove. A plurality of tooth/groove pairs each comprise one of the plurality of teeth and one of the plurality of grooves that axially correspond whereby each of the plurality of tooth/groove pairs engage when the first jaw interlocks with the first body. In one or more embodiments, at least two of the tooth/groove pairs have a difference between tooth height and groove depth that are different from each other.

In one or more embodiments, the tooth height of at least one of the plurality of the teeth is different than the tooth height of at least one other of the plurality of the teeth so the plurality of teeth are not colinear.

In one or more embodiments, within at least one of the plurality of tooth/groove pairs in the first jaw, the tooth height of at least one of the plurality of the teeth is greater than a groove depth of at least one of the plurality of the grooves.

A tooth taper angle is measured between a line tangent to the top side and a radial plane perpendicular to the central longitudinal axis. In one or more embodiments, the tooth taper angle for each of the plurality of teeth is the same. A groove taper angle is measured between a line tangent to the outer side and the radial plane. In one or more embodiments, the groove taper angle is different than the tooth taper angle.

In one or more embodiments, the groove taper angle is greater than the tooth taper angle.

In one or more embodiments, the groove taper angle is less than the tooth taper angle.

A tooth taper angle is measured between a line tangent to the top side and a radial plane perpendicular to the central longitudinal axis. In one or more embodiments, the tooth taper angle for each of the plurality of teeth is the same. A groove taper angle is measured between a line tangent to the outer side and the radial plane. In one or more embodiments, the groove taper angle is equal to the tooth taper angle.

In one or more embodiments, the connector also includes a second jaw comprising a plurality of teeth formed on an inside of the segments axially separated from the first jaw. In one or more embodiments, the second jaw has a second locking profile that corresponds in shape with a second receiving profile on an outside of the second body.

In one or more embodiments, the connecting assembly also includes a main piston positioned around at least a portion of the connector. In one or more embodiments, when the main piston is in an unlocked position, at least one of the first or second ends of the connector is in a disconnected position. In one or more embodiments, when the main piston is in a locked position, both the first end and the second end of the connector are in a connected position.

In one or more embodiments, the first body is a wellhead.

In one or more embodiments, a tooth spacing between each of the plurality of teeth is equivalent to a groove spacing between each of the plurality of grooves.

One or more embodiments include a connecting assembly for connecting a first body and a second body. The first body includes a plurality of grooves formed on an outside of the first body near a connecting end, with each groove having a front side closest to the connecting end, a base side, and a back side opposite the front side. The connecting assembly includes a connector. The connector includes a central longitudinal axis extending lengthwise through a center of the connector; and a first jaw formed on an inside of the connector near a first axial end of the connector. The first jaw includes a plurality of teeth, each tooth having a leading side facing an axial center of the connector, a top side, and a trailing side opposite the leading side. A tooth leading angle is measured between a line tangent to the leading side and a radial plane perpendicular to the central longitudinal axis. A groove front angle is measured between a line tangent to the front side and the radial plane. In one or more embodiments, the tooth leading angle is different than the groove front angle.

In one or more embodiments, a tooth height of at least one of the plurality of the teeth is different than at least a tooth height of at least one other of the plurality of the teeth so the plurality of teeth are not colinear.

In one or more embodiments, the groove front angle is greater than the tooth leading angle.

In one or more embodiments, a tooth spacing between each of the plurality of teeth is equivalent to a groove spacing between each of the plurality of grooves.

In one or more embodiments, a tooth height of at least one of the plurality of teeth in the first jaw is less than a groove depth of the groove in a tooth/groove pair.

One or more embodiments include a connecting assembly for connecting a first body and a second body. The first body includes a plurality of grooves formed on an outside of the first body near a connecting end. The connecting assembly includes a connector. The connector includes a plurality of connecting segments arranged circumferentially around a central longitudinal axis; and a first jaw formed on an inside of the segments. The first jaw includes a plurality of teeth. Each tooth includes: a leading side facing an axial center of the connector; a top side; and a trailing side opposite the leading side. A tooth taper angle is measured between a line tangent to the top side and a radial plane perpendicular to the central longitudinal axis. Each groove includes: a front side closest to the connecting end; a back side opposite the front side; a base side extending between the front side and the back side; and an outer side extending between adjacent grooves. A groove taper angle is measured between a line tangent to the outer side and the radial plane. In one or more embodiments, the tooth taper angle is different than the groove taper angle.

In one or more embodiments, a tooth spacing between each of the plurality of teeth is equivalent to a groove spacing between each of the plurality of grooves.

In one or more embodiments, a tooth height of at least one of the plurality of teeth in the first jaw is less than a groove depth of the groove in a tooth/groove pair.

In one or more embodiments, a tooth height of at least one of the plurality of the teeth is different than at least a tooth height of at least one other of the plurality of the teeth so the plurality of teeth are not colinear.

Other aspects and advantages of the invention will be apparent from the following description and the appended claims.

DETAILED DESCRIPTION

Figure 1:
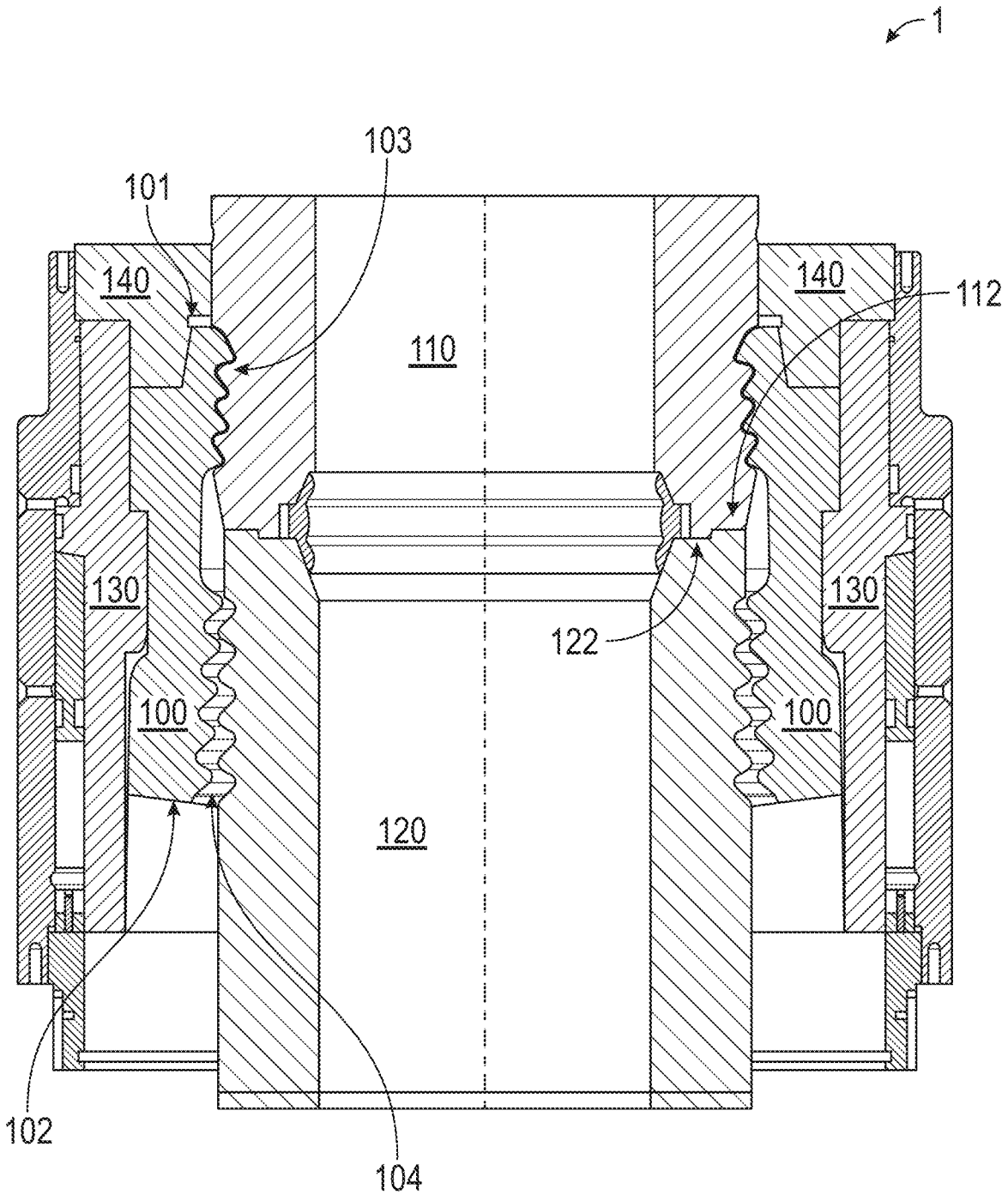
FIG. 1 depicts a connecting assembly in the unlocked configuration according to one or more embodiments.
Figure 2:
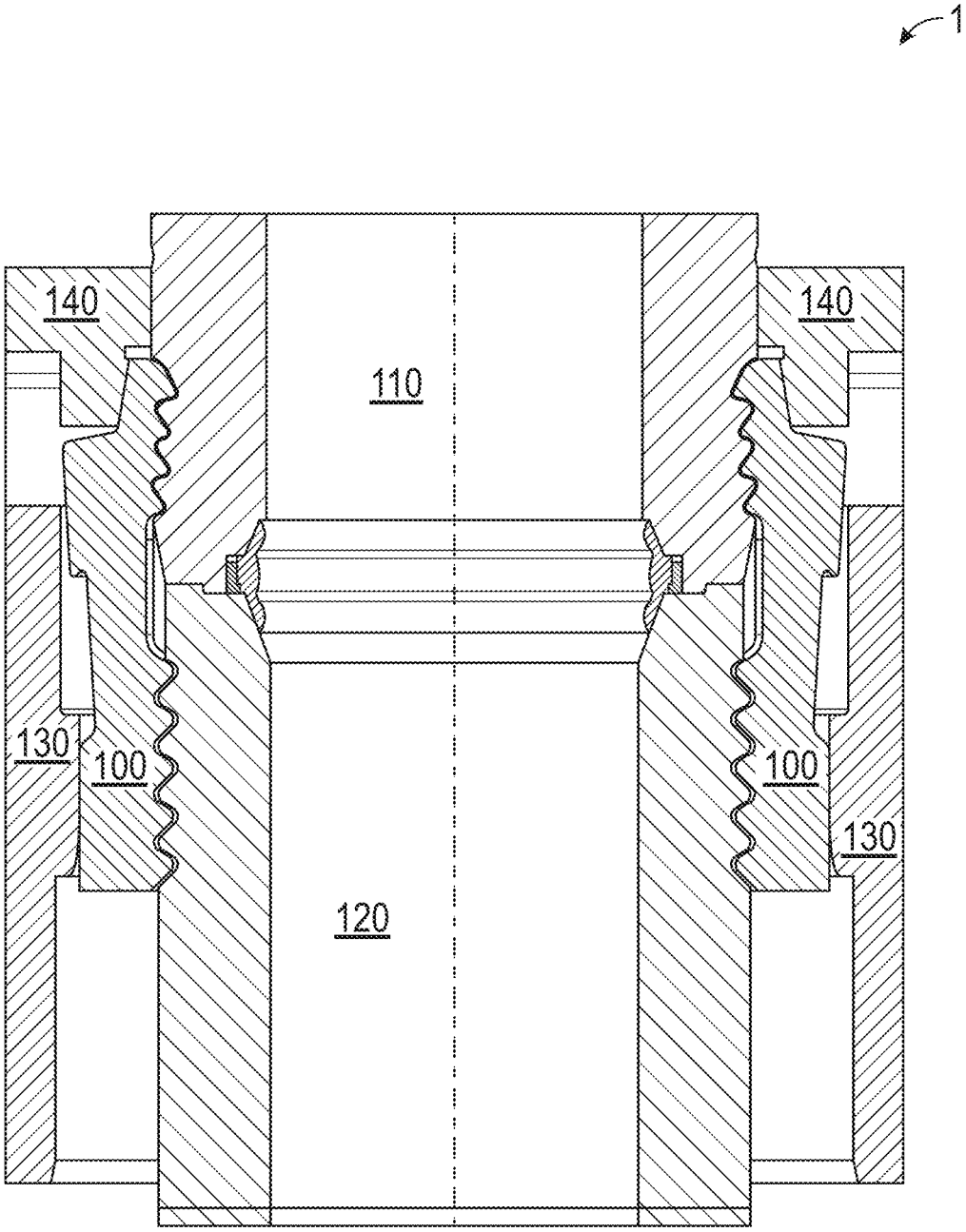
FIG. 2 depicts the connecting assembly shown in FIG. 1 in the locked configuration according to one or more embodiments.

For example, referring collectively to FIGS. 1 and 2, a connecting assembly 1 according to embodiments of the present disclosure including a connector 100 and a main piston 130 may be encompassed around the axial ends of a second body 110 and a first body 120 to connect the axial ends of the bodies together. In the embodiment shown, the bodies 110, 120 are cylindrical fluid conduits, such as piping or tubular components, having a flow path, or channel, therethrough.

The connector 100 includes a channel that extends longitudinally through the connector from a second end 101 to a first end 102; has an inside and an outside; and is able to surround a part of the second body 110 and a part of the first body 120. The connector 100 may be segmented along its length into multiple connecting segments, for example collets, the ends of which are each capable of moving radially. For example, in some embodiments, connecting segments may be formed by first machining a tubular section having the desired shape for connecting two bodies, and then cutting the tubular section axially along its entire length into the connecting segments. Connectors of the present disclosure may be formed of two or more connecting segments, for example, ranging from 2 to 16 connecting segments, or more than 16 connecting segments, depending on, for example, the size and shape of the bodies being connected. The connecting segments may be arranged circumferentially around one or both bodies being connected to form the connector, and the connecting segments may be held in place by one or more rings (e.g., adjustment ring 140).

As shown, a first jaw 104 formed on the inside of the connector near the first end 102, axially spaced apart from the second jaw 103, has a first locking profile (i.e., the cross sectional shape of the first jaw) that generally corresponds in shape with a first receiving profile on an outside of the first body 120. A second jaw 103 is formed on the inside of the connector near the second end 101, where the second jaw 103 has a second locking profile (i.e., the cross sectional shape of the second jaw) that corresponds in shape with a second receiving profile on an outside of the second body 110. The first jaw 104 and second jaw 103 may be formed around the inside of the connector on each of the connecting segments, such that each of the connecting segments may move radially inward (e.g., to engage and lock with a receiving profile) or radially outward.

In the embodiment shown, the first and second receiving profiles of the bodies may each have one or more grooves extending radially around the outside of the bodies to form a generally undulating cross sectional profile. The connector 100 may include one or more ridges or protrusions (which may be described herein as "teeth") extending radially around the inside of the connector 100, where the cross-sectional shape of such ridges form the first and second locking profiles. In some embodiments, one or more of the ridges may have a cross sectional profile of a beveled tooth. When the locking profiles are axially aligned and engaged with the receiving profiles, such as shown in FIG. 2, the locking profiles may fit within the corresponding receiving profiles, even though one or more of the teeth in the first and/or second jaw may have a cross sectional shape that differs from the cross sectional shape of the receiving profile groove in which the tooth fits.

A main piston 130 having a generally tubular body may at least partially surround the outside of the connector 100. According to embodiments of the present disclosure, a flat-to-flat locking mechanism may be used between the main piston and connector. Alternatively, a tapered locking method could be employed between the main piston and the connector. For example, as shown in the embodiment of FIGS. 1 and 2 that employ a flat-to-flat locking mechanism, the cross sectional shapes of the inside of the main piston 130 and the outside of the connector 100 may have corresponding stepped segments parallel with their central axes forming a flat-to-flat locking mechanism. This type of locking method allows preload of the main piston around the connector to be set off-site (e.g., in a factory), and, as the flat-to-flat interface induces no axial force, does not require pressure or any alternative mechanism to keep the connector locked. Other connecting assemblies may use a tapered locking method, where the piston wedges locking segments into a receiving locking profile. A tapered locking method may allow preload to be set in the field by applying different locking hydraulic pressures, but requires a secondary locking mechanism to prevent the axial force from inducing unlocking. Accidental unlocking can also be induced in some connectors by VIV (Vortex Induced Vibrations).

In some embodiments, the piston 130 may be hydraulically actuated to move axially along the outside of the connector. However, other actuation methods, such as manual activation, may be used to move the piston to lock and/or unlock the connector.

As used herein, the axial direction may refer to the direction parallel to the axis of the bodies or the direction parallel to the channel axis through the connector. Therefore, the axial direction may also be parallel to the direction of fluid flow within either body. The radial direction may refer to the direction of the radius of the bodies. Thus, the radial direction and the axial direction are perpendicular.

When the main piston 130 is in an unlocked position, such as shown in FIG. 1, the first end 102 of the connector 100 may be in a radially outward position, while the second end 101 of the connector may be in a radially inward position. In the unlocked configuration, the main piston 130 may, either directly or indirectly, hold the second end 101 of the connector in this radially inward position. In the embodiment depicted in FIGS. 1 and 2, the main piston does not directly hold the second end 101 of the connector in the radially inward position. Instead, the second end is held in the radially inward position by one or more intermediate components, like the adjustment ring 140, that is then held in place by threading around the second body 110, by the main piston 130, or by other means. The first end 102 being in a radially outward position allows the first end of the connector to move into position around the outside of the first body 120 in preparation for transition to the locked configuration. Once moved around the first body, the first jaw 104 is radially outside the first receiving profile in the first body, and the second jaw 103 is in a locking engagement with the second receiving profile of the second body 110. As the connector 100 moves around the first body, parts of the first jaw 104 may be spaced apart from the first receiving profile and parts of the first jaw 104 may be in contact with the first receiving profile. In an alternative embodiment of the connecting assembly, both the second end 101 and the first end 102 of the connector are in a radially outward position when in the unlocked configuration. In this embodiment, movement of the main piston may still radially move the first and second ends, either directly or indirectly. Discussion herein of the main piston causing the connector to engage with the first and second bodies does not imply direct contact of the main piston with one or both ends of the connector. All embodiments described herein may further include one or more intermediate components to transfer the force of the main piston to the first and/or second ends of the connector. In some embodiments, intermediate component(s) may be disposed between the main piston and the first and/or second ends of the connector.

When the main piston 130 is in a locked position, such as shown in FIG. 2, the first end 102 of the connector 100 and the second end 101 of the connector 100 may be in radially inward positions (both radially compressed by the main piston assembly). In such a position, the first jaw 104 is in a locking engagement with the first receiving profile of the first body 120, and the second jaw 103 is in a locking engagement with the second receiving profile of the second body 110. A radially inward position of both the first end and second end of the connector connects the first and second bodies. Thus, the connector connects the first body to the second body by interlocking the first locking profile with the first receiving profile and interlocking the second locking profile with the second receiving profile.

As such, the axial position of the main piston dictates the position of the first end of the connector. Furthermore, axial motion of the main piston moves the first end of the connector between the radially outward position and the radially inward position.

According to embodiments of the present disclosure, axial movement of the main piston 130 may cause the second jaw 103 of the connector 100 to lock with the second receiving profile of the second body 110 prior to aligning the second axial end 112 of the second body 110 with the first axial end 122 of the first body 120. The main piston 130 may directly lock the connector 100 into the second receiving profile of the second body 110, or may indirectly lock the connector 100 into the second receiving profile of the second body 110 through one or more intermediate components, such as the adjustment ring 140 in the embodiment depicted in FIG. 1. The second body 110 and connecting assembly (including the connector 100 and main piston 130) may then be aligned with the first body 120, such that the second axial end 112 of the second body 110 interfaces (or is proximate to) the first axial end 122 of the first body 120 and the first end 102 of the connector 100 surrounds the first axial end 122 of the first body.

An "interface" between connected first and second bodies is an imaginary plane that extends radially between the axial ends of the first body and the second body, and is perpendicular to the axial direction of the bodies. Accordingly, once the first and second bodies are connected, the interface is the imaginary plane that extends outward from the contact surface between the first body and the second body.

In some embodiments, the axial ends of the first and second bodies may be in direct contact along the interface therebetween. In some embodiments, a gasket may be positioned between the axial ends of the first and second bodies, such that the axial ends of the first and second bodies are adjacent to each other although not necessarily in direct contact with each other. In such a position, the second body may be roughly radially aligned with the first body. Additionally, the second body may be axially close enough to the first body that the two can be successfully connected with the connector.

In embodiments including a gasket between adjacent first and second bodies, the adjacent bodies may maintain a certain level of axial separation even when the full weight of one of the bodies is transmitted through the gasket to the other body but when the connecting assembly is in an unlocked configuration. The amount of axial separation between two adjacent but not fully connected bodies may be referred to as gasket "stand-off."

The embodiment shown in FIGS. 1 and 2 is oriented to where a second body is positioned axially on top of a first body, and the main piston is moved vertically downward to a locked position. However, other orientations of the first and second bodies and axial piston movement may be used in application of the present disclosure. For example, a second body may be axially atop a first body in an unlocked configuration with the connector compressed around the second body, and a main piston may move upward to a locked position, causing the connector to be compressed around the first body. In a further example, components to be connected may be oriented in a horizontal position, where axial movement of the main piston around the connector may be horizontal rather than vertical with respect to the ground.

Figure 3:
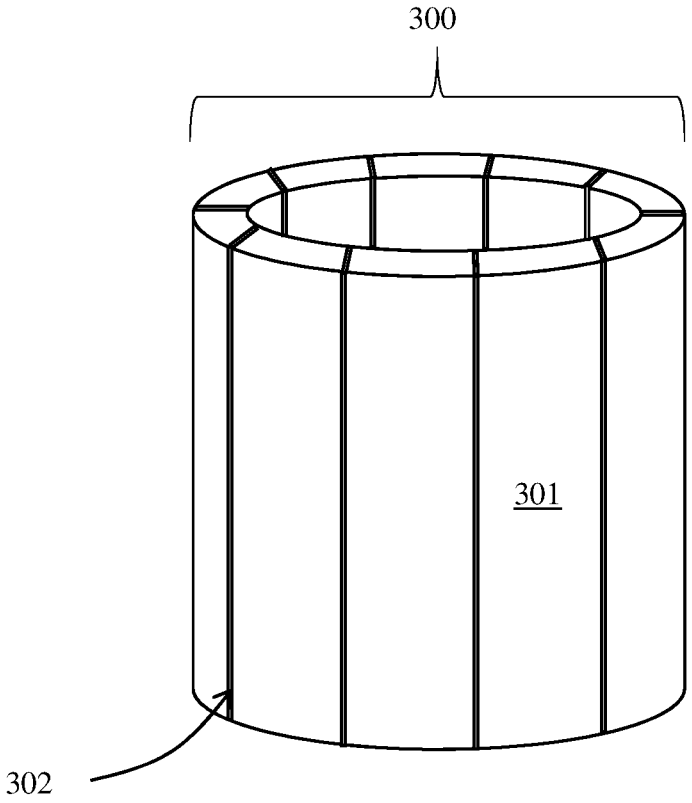
FIG. 3 shows a perspective view of a connector formed of multiple segments according to embodiments of the present disclosure.

As shown in FIG. 3, a connector 300 may include multiple connecting segments 301. The connecting segments 301 may be held in a circumferential arrangement around a central longitudinal axis by a main piston, an adjustment ring, or other methods (not depicted here), where a gap 302 may be formed between adjacent segments 301, or in some embodiments, adjacent segments may contact each other at one or more points of contact. Further, the connecting segments 301 may be held together by more than one component along their longitudinal length, for instance, a separate component toward each axial end. In one or more embodiments, the segments 301 are held together to form a generally hollow-cylindrically-shaped connector 300, while the jaws may be formed on the inside of the axial ends of each of the segments 301. Some embodiments of the connector 300 will have 16 segments 301. Other embodiments may have 10 segments (as depicted in FIG. 3) or another number of segments, for instance, 4, 6, 8, 12, 15, 20, 24, or 32. In some embodiments, creating the segments may involve initially forming a connector blank in the shape of a hollow cylinder with the intended internal structure (e.g., teeth) that is subsequently cut into multiple segments having a radial segment shape. The connector blank may be precisely cut in the axial direction or may be cut at an angle deviating from axial direction. A connector formed this way may have essentially identical segments or may have segments of multiple sizes and/or geometries.

According to embodiments of the present disclosure, other connector types having jaws formed thereon may be used, where the connector may have a central longitudinal axis extending through the length of the connector. The different connector types may be arranged around a body to be connected such that a jaw formed on the connector may engage with grooves formed in the body.

Connecting assemblies of the present disclosure may include locking profiles and corresponding receiving profiles having multiple ridges, or teeth, and multiple corresponding grooves. For example, a locking profile may include 1, 2, 3, 4, 5, 6, or more teeth, and a corresponding receiving profile may include the same amount of grooves as there are teeth in the locking profile (e.g., 1, 2, 3, 4, 5, 6, or more grooves). In some embodiments, the number of teeth in the locking profile may be less than the number of grooves in the corresponding receiving profile.

The profile shape of one or more teeth in a locking profile may be a matching inverse of the corresponding groove in which the tooth is to fit. As used herein, a matching inverse means the cross sectional shape of the tooth has substantially the same shape and substantially the same size as the cross sectional shape of the corresponding groove, where the size of the cross sectional shape of the tooth allows the tooth to fit within the corresponding groove with minimal tolerance gaps.

Figure 4:
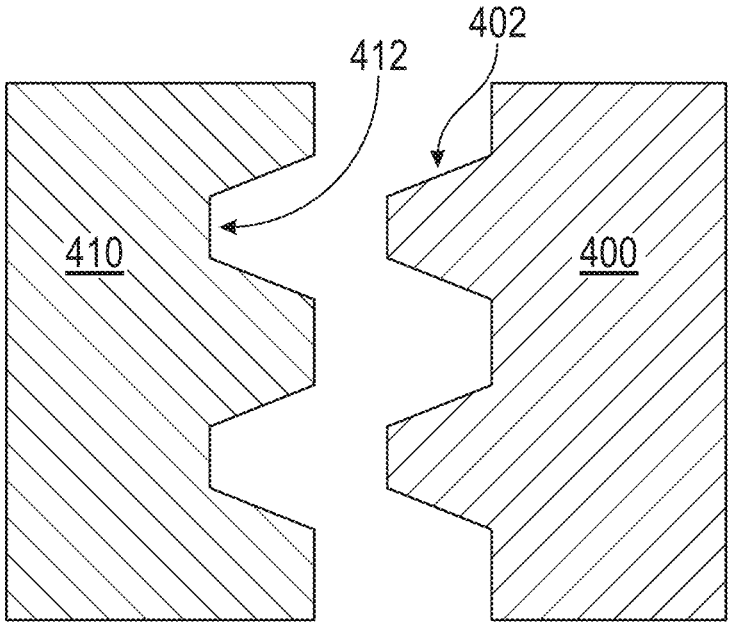
FIG. 4 shows a locking profile and corresponding receiving profile according to embodiments of the present disclosure.
Figure 5:
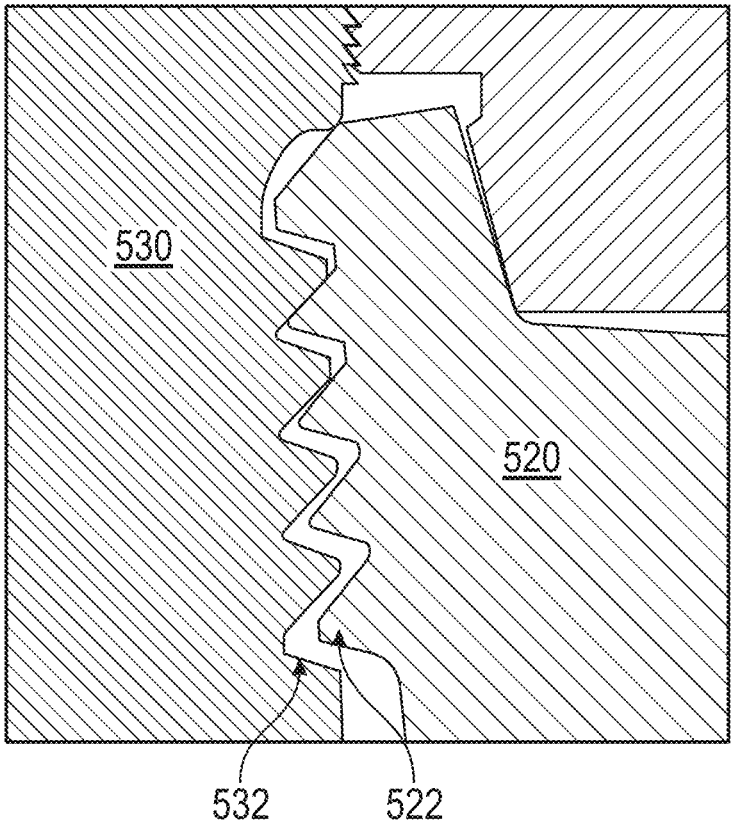
FIG. 5 shows a cross sectional view of a body being connected to a connector jaw according to embodiments of the present disclosure.

FIGS. 4 and 5 show examples of components with locking profiles that are matching inverses with corresponding receiving profiles in components being connected. As shown in FIG. 4, a locking profile formed in a connector 400 includes multiple teeth 402. The locking profile is aligned with a corresponding receiving profile formed in a component 410 to be connected, where the receiving profile includes multiple grooves 412 that have the same shape and substantially the same size as the cross sectional shape of the teeth 402 (where the size of the teeth 402 may fit within the size of the grooves 412, allowing for manufacturing tolerances). A tooth 402 that fits into a groove 412 when the locking profiles are interlocked (as occurs when the connector is in a locked configuration) are said to be a tooth/groove pair. A connector 400 and a component 410 to be connected may have a plurality of tooth/groove pairs. In the embodiment shown, the teeth 402 and grooves 412 have trapezoidal cross sectional shapes. Trapezoidal cross sectional shapes of teeth and/or grooves may have angled corners, such as shown in FIG. 4, or may have rounded corners.

In the embodiment shown in FIG. 5, a locking profile formed in a connector 520 includes multiple teeth 522 having a generally triangular cross sectional shape. The locking profile is aligned with a corresponding receiving profile formed in a component 530 to be attached, where the receiving profile includes multiple grooves 532 that have substantially the same shape and size as the cross sectional shape of the teeth 522. Triangular cross sectional shapes of teeth and/or grooves may have angled or rounded corners.

Figure 6:
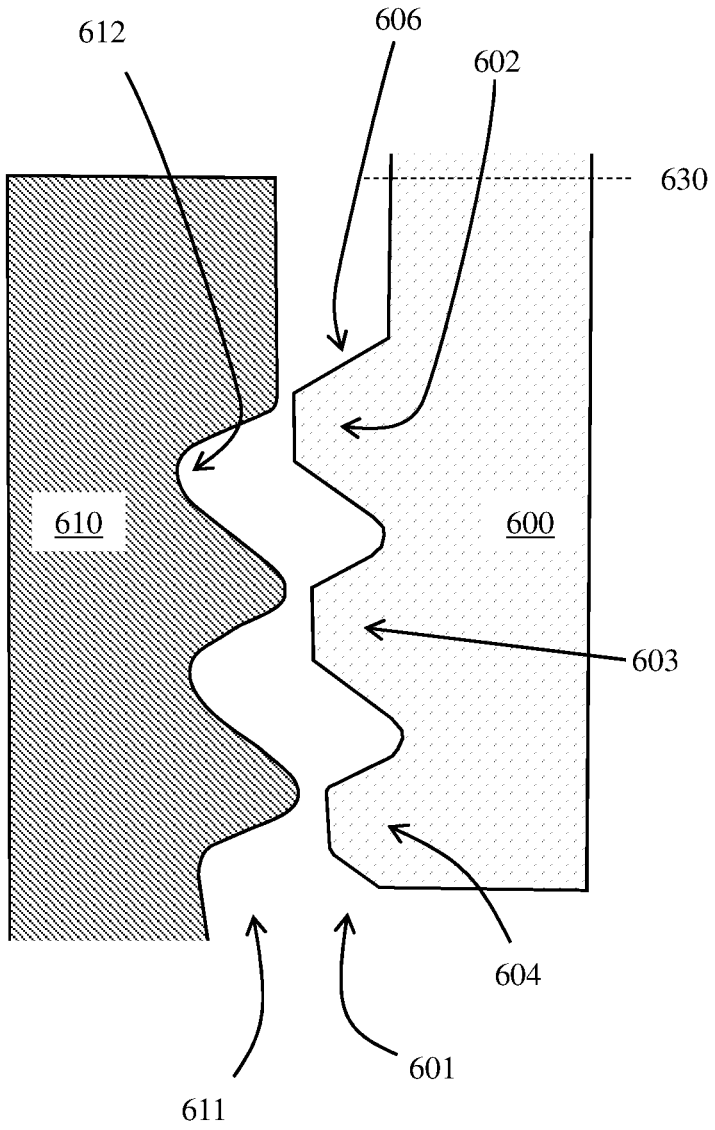
FIG. 6 depicts a locking profile and corresponding receiving profile according to embodiments of the present disclosure.

According to embodiments of the present disclosure, the profile shape of one or more teeth in a locking profile may be an approximate inverse of the corresponding groove in which the tooth is to fit (i.e., the tooth and groove that form a tooth/groove pair), where although the tooth and groove of a tooth/groove pair may have a different size and/or shape, the tooth may still interlock with and fit within the groove. For example, FIG. 6 shows an example of a connector 600 with a jaw locking profile 601 that is an approximate inverse of a corresponding receiving profile 611 formed in a component 610 to be connected. The locking profile 601 may include multiple teeth 602, 603, 604 having different cross sectional shapes.

Further, in the embodiment shown, the receiving profile 611 includes multiple grooves 612 that each have a different cross sectional shape than the cross sectional shape of the teeth 602, 603, 604. The teeth 602, 603, 604 each have a general cross sectional shape of a truncated triangle, while the grooves 612 each have a general cross sectional shape of a triangle with a rounded tip. However, other cross sectional shapes of grooves and teeth may be utilized according to embodiments described herein, including for example, triangular or trapezoidal cross sectional shapes with rounded and/or angled corners. Further, according to embodiments of the present disclosure, one or more grooves in a receiving profile may have a different cross sectional shape than the cross sectional shape of teeth in a corresponding locking profile, while the remaining grooves in the receiving profile may have the same cross sectional shape as the cross sectional shape of the remaining teeth in the corresponding locking profile.

Teeth in a locking profile may be designed for sequential interaction with a corresponding receiving profile as the locking profile is engaged with the receiving profile. For example, as described above, a jaw of a connector may be locked around a body by substantially aligning the locking profile of the jaw with a receiving profile formed in the body and then sliding a main piston around the jaw. As the main piston slides axially around the connector, the main piston may apply radially inward force sequentially to each tooth of the jaw of the connector in the axial order in which the main piston slides, thereby engaging the locking profile of the jaw with the receiving profile of the body. For example, in the embodiment shown in FIGS. 1 and 2, as the main piston 130 slides in an axial direction from the second end 101 of the connector to the first end 102 of the connector, increasing radially inward force may be applied to each tooth of the first jaw 104 sequentially in the direction of axial movement of the main piston 130 through direct contact of the main piston and the first end 102 of the connector. In other embodiments, axial movement of the main piston 130 may indirectly cause the radial inward force of the first end 102 of the connector through direct contact with one or more intermediate components that are disposed between the main piston and the first end.

In such a manner, as a main piston slides axially from the axial center 630 of a connector toward an axial end of the connector, a first tooth 602 in a jaw axially closest to the axial center of the connector may first engage with and lock into a corresponding groove of a receiving profile in a body, then a second tooth 603 in the jaw may move into final locking position with a corresponding groove of the receiving profile, and lastly, a third and last tooth 604, axially farthest from the axial center 630, may move into final locking position with a corresponding groove of the receiving profile. Further, as the first tooth engages with and moves into a final locking position, axial forces between the tooth locking profile and corresponding receiving profile may aid in moving the bodies being connected toward each other. For example, moving and locking teeth of a connector jaw into corresponding grooves of a first body may axially shift the first body toward a second body already locked to the connector, such that the first and second bodies are connected at a fluid tight interface once the connecting assembly is in a final locking position. Thus, prior to moving a locking profile into a final locking position with a corresponding receiving profile, the locking profile may be axially offset from the receiving profile.

Figure 7:
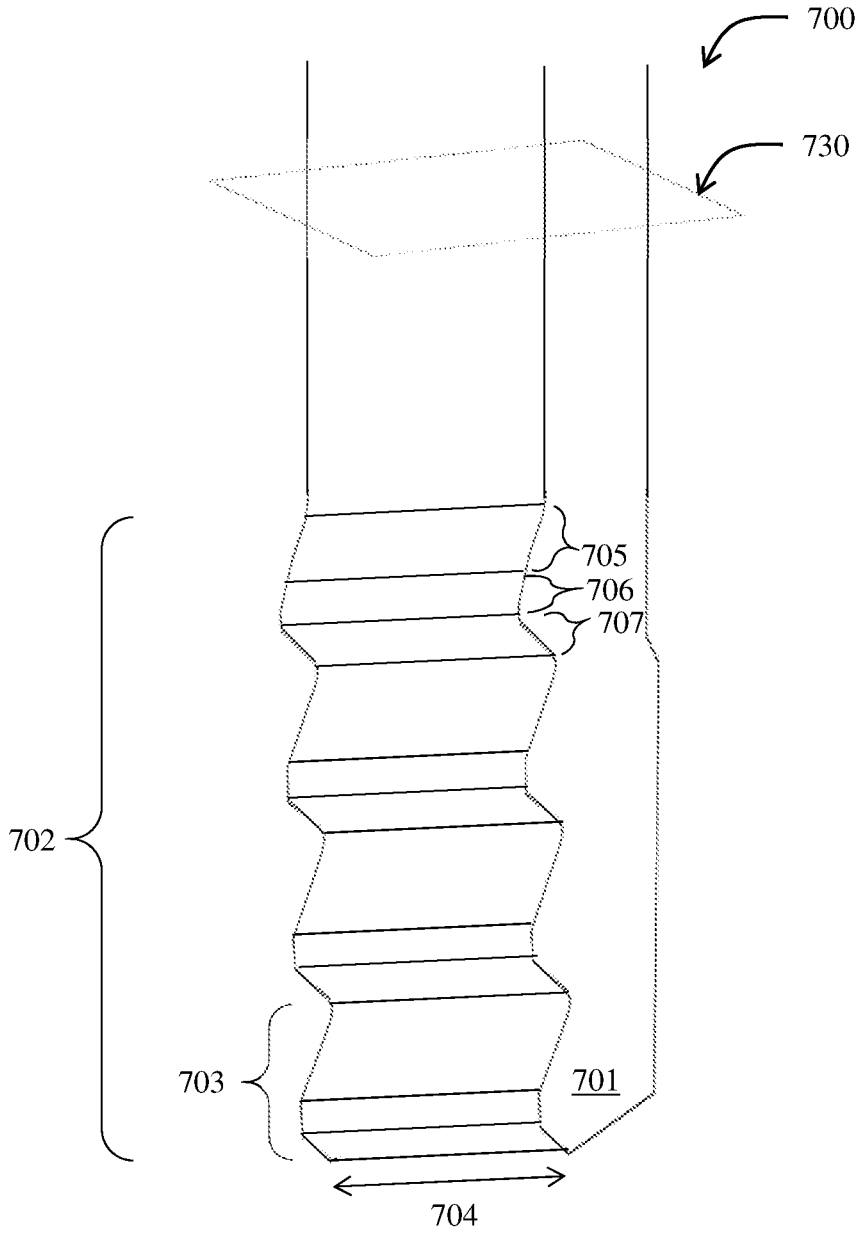
FIG. 7 shows a perspective view of a jaw formed on the inside of a connector according to embodiments of the present disclosure.

FIG. 7 shows a partial perspective view of a single connecting segment 701 of a connector 700. The inside of the segment 701 has a jaw 702 formed by multiple teeth 703 spaced axially apart from each other and extending linearly across the width 704 of the segment 701 (from one side of the segment to the opposite side of the segment). Each tooth 703 forming a jaw 702 of a segment may have a leading side 705, a top side 706, and a trailing side 707 (opposite the leading side of the tooth). The transitions between the sides of a tooth may be angular or curved transitions. For example, an angular transition between the leading side 705 and the top side 706 and between the top side 706 and the trailing side 707 of each tooth is shown in the embodiment in FIG. 7. As used herein, a leading side of a tooth may refer to the side of the tooth axially closest to the axial center 730 of the connector 700. Accordingly, the leading side of a tooth may also, in some embodiments, be the side of the tooth that first contacts with a corresponding groove in a receiving profile during a connection process. In some configurations, the leading side of a tooth may also be in contact with the corresponding groove once the connecting assembly is in the locked configuration. A top side of the tooth may refer to the side of the tooth defining the height of the tooth from a base of a tooth, where the tooth begins to protrude from the segment. The trailing side of a tooth may refer to the side of the tooth opposite the leading side, where a thickness of the tooth may be measured between the leading and trailing sides of the tooth. The segment 701 depicted here is not radially curved; however, in other embodiments, the segment 701 may be curved in the radial direction to better contact and engage with a body that is cylindrical in shape. The segments 701 will often be curved in the radial direction when they are formed from a connector blank, having a hollow-cylindrical shape, that has been axially cut into the desired number of segments 701, as described above.

As shown in the embodiment of FIG. 7, a tooth 703 may extend linearly across an entire width 704 of the segment on which the tooth is formed. In some embodiments, the profile of a tooth, defined by the cross-sectional shape of the tooth along an axial plane perpendicular to the surfaces at the leading, top and trailing sides of the tooth, may be uniform along the entire width of the tooth.

Figure 8:
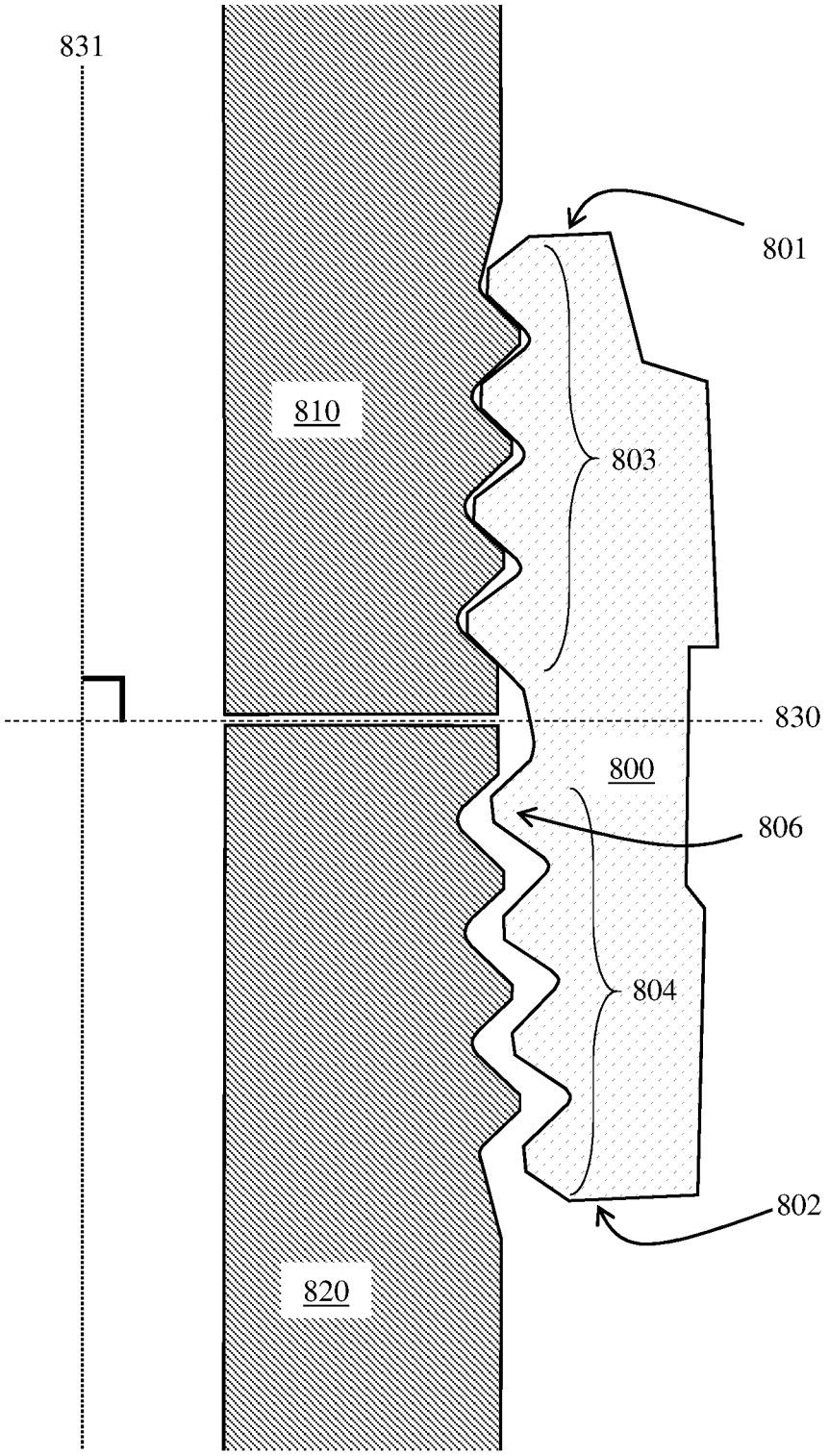
FIG. 8 shows a cross sectional view of two bodies being connected together by a connector according to embodiments of the present disclosure.

Referring now to FIG. 8, FIG. 8 shows a cross sectional view of a connector 800, used to connect a second body 810 to a first body 820, where the connector 800 has a plurality of teeth forming a first and second jaw 804, 803, including a first tooth 806 closest to the axial center 830 of the connector. A centerline 831 is also illustrated, which may be disposed through a center of a channel through which fluid may flow. The centerline 831 may be orthogonal to the axial center 830. As shown, the connector 800 has a second end 801, a second jaw 803 formed on the inside of the connector near the second end, a first end 802 at the opposite axial end from the second end 801, and a first jaw 804 formed on the inside of the connector near the first end 802. The cross sectional view of the first and second jaws 804, 803 show the locking profiles formed by the teeth of each jaw. Further, the cross sectional view of the first and second bodies 820, 810 show receiving profiles of grooves formed around the axial ends of the bodies. When axially aligned, the locking profiles of the connector may fit within corresponding receiving profiles in the first and second bodies 820, 810.

Figure 9:
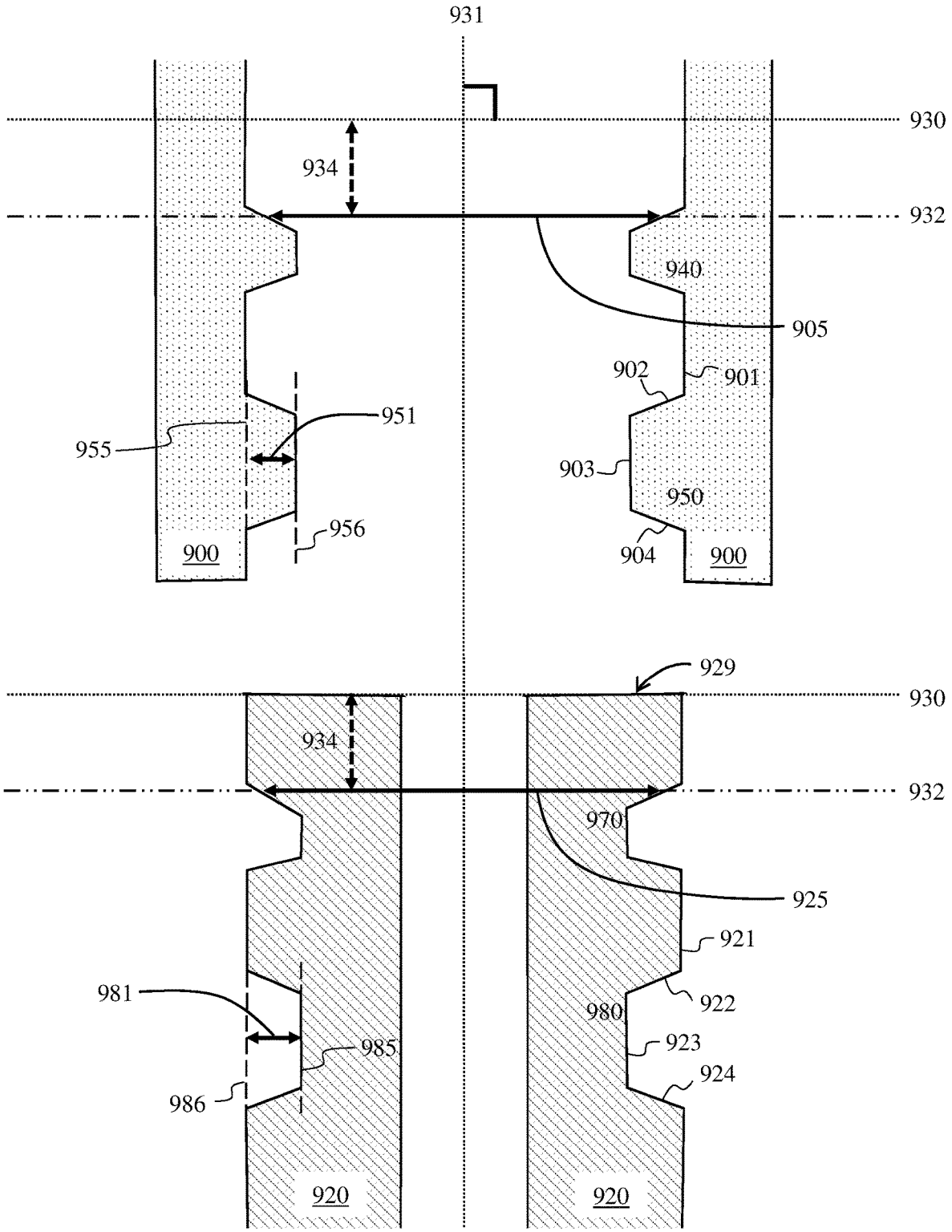
FIG. 9 depicts a partial cross sectional view of a connector and a first body around which the connector may be connected according to embodiments of the present disclosure.

FIG. 9 depicts a partial cross sectional view of a connector 900 and a first body 920 around which the connector 900 may be connected. The connector 900 includes a jaw having a first tooth 940 closest to an axial center 930 of the connector 900 and a second tooth 950 axially farther from the axial center 930 than the first tooth 940. The first body 920 includes a receiving profile formed by a first groove 970 and a second groove 980 at an axial end of the body 920. The axial center 930 is shown with the profile of the first body 920 to indicate the axial position of the connector 900 when the connector is connected around the first body 920. Further depicted for each component are an axial measurement distance 934, measured perpendicular to the axial center 930, and a first radial plane 932, which is parallel to the axial center 930 at a distance of the axial measurement distance 934. An internal diameter 905 of the connector 900 and an external diameter 925 of the first body 920 are measured at the same axial measurement distance 934. In this embodiment, the measurements are taking place comparing a first tooth 940 with a first groove 970. However, the measurements can occur at any point on the two components. When the connector 900 is fastened on the first body 920, points on each component at the same axial measurement distance 934 may be in the same horizontal plane and may be in contact. Although the axial center 930 of a connector may vary depending on the shape and size of the connector, the external diameter 925 of the first body and internal diameter 905 of the connector are still measured relative to the same reference point, and thus, they should be axially aligned when connecting apparatus is in the locked configuration, and thus may be in contact. Finally, a centerline 931 is illustrated, which may be disposed through a center of a channel through which fluid may flow. The centerline 931 may be orthogonal to the axial center 930.

Locations on each body with a constant axial measurement distance 934 from the axial center 930 are said to have "axially corresponding locations" or to be "axially corresponding." While the axial measurement distance 934 is depicted in FIG. 9 as resulting in measurements at a top side of a first tooth 940 of the connector 900 and in the base of the corresponding groove of the first body 920, the axial measurement distance 934 can point to a measurement location along any of the surfaces of either component (e.g., between teeth, on the top side of a tooth, along the leading side/trailing side of a tooth, etc.). Further, the tooth shape or the incorporation of additional features into the cross sectional shape of a tooth may not impact the establishment of an axial measurement distance 934. The axial measurement distance 934 may be measured at any height relative to the axial center 930 that exists on both the connector 900 and the first body 920. Furthermore, the same guidelines and measurements (i.e., the axial center and the axial measurement distance) can be established to compare the connector 900 with a second body (not depicted).

The internal diameter 905 of the connector 900 may be measured prior to assembling the connector to the first body 920 or after assembling the connector to the first body 920. In some embodiments, prior to assembling the connector to the first body, the internal diameter 905 of the connector may be smaller than the external diameter 925 of the first body. In some embodiments, as is depicted in FIG. 9, the axial measurement distance 934 may be measured along the leading side 902 of a tooth and along the front side 922 of the groove (where the tooth and the groove form a tooth/groove pair) at an axially corresponding height. In some embodiments the axial measurement distance 934 may be measured along the top side 903 of the tooth and along the base side 923 of the groove (where the tooth and the groove form a tooth/groove pair) at an axially corresponding height. In some embodiments, the axial measurement distance 934 may be measured along the trailing side 904 of a tooth and along the back side 924 of the groove (where the tooth and the groove form a tooth/groove pair) at an axially corresponding height.

One way to increase load transfer between the first body and the second body through the connector, according to one or more embodiments, may be designing the inner diameter to be be smaller than the external diameter of the body while maintaining the axial alignment of the teeth and grooves. A difference between the inner and outer diameters may be due to one or more angular differences between the angles of the connector and the angles of the second body, as discussed below. In some embodiments where the inner diameter may be smaller than the external diameter, the axial measurement distance may be measured within the pair of surfaces that are in contact when the connector is in the locked configuration (i.e., the contacting surfaces). In some embodiments, the leading side 902 of the tooth and the front side 922 of the groove may be in contact when the connector is in the locked configuration. In some embodiments, the top side 903 of the tooth and the base side 923 of the groove may be in contact when the connector is in the locked configuration. In some embodiments, the top side 903 of the tooth and the base side 923 of the groove may not be in contact and may have space between them. In some embodiments, the trailing side 904 of the tooth and the back side 924 of the groove may be in contact when the connector is in the locked configuration. In some embodiments, the trailing side 904 of the tooth and the back side 924 of the groove may not be in contact and may have space between them. In some embodiments, there may be space between both the top side 903 of the tooth and the base side 923 of the groove as well as space between the trailing side 904 of the tooth and the back side 924 of the groove. The space between 903 and 923 and/or between 904 and 924 may help maintain connection efficiency, may help provide clearance for closure, and/or allow for manufacturing tolerances. In some embodiments, the internal diameter 905 may be smaller than the external diameter 925 by at least 0.05% (e.g., at least 0.10%, at least 0.15%, at least 0.2%, at least 0.3%, at least 0.5%, at least 0.7%, at least 1.0%, at least 1.5%, at least 2.0%, etc.) at a shared axial position. In such embodiments, a smaller internal diameter 905 may create connector preload. The internal diameter 905 may be smaller than the external diameter 925 within several regions of the connector to define a total connector preload.

In some embodiments, the axial measurement distance 934 may be measured along a tooth of the connector 900 and at the location within a groove of the first body 920 (where the tooth and the groove form a tooth/groove pair) at an axially corresponding height.

Also depicted in FIG. 9 is a tooth and a groove, with the faces labeled. The second tooth 950 and second groove 980 are used as an example, but the same labels are used for every tooth and every groove. On the second tooth 950 is a leading side 902 facing the axial center 930, a top side 903, and a trailing side 904 opposite the leading side. Additionally, an inner side 901 extends between adjacent teeth. In the second groove 980 is a front side 922 closest to a connecting end 929, a base side 923, and a back side 924 opposite the front side. Additionally, an outer side 921 extends between adjacent grooves.

The second tooth 950 is also used as an example to show the measurement of the tooth height, which is measured between the base of the tooth and the top side of the tooth. As shown, the second tooth 950 has a second tooth height 951 measured between a line 956 tangent to the top side and a line 955 tangent to the base of the tooth. The line 955 tangent to the base of the tooth may be delineated by drawing a line between the base at the leading side of the tooth and the base at the trailing side of the tooth. The line 956 tangent to the top side may be drawn at a point on the tooth farthest away from the base line. For example, in the tooth profile shown, the top side 903 of the teeth are planar, and the line tangent to the top side may be drawn along substantially the entire top side of the tooth. In other embodiments, a tooth top side may be curved, where the line tangent to the top side may be drawn at the highest point along the curve and parallel with the line tangent to the base of the tooth.

Similarly, the second groove 980 is used as an example to show the measurement of the groove depth, which is measured between the base side 923 of the groove and the top of the groove. As shown, the second groove 980 has a second groove depth 981 measured between a line 985 tangent to the base side of the groove and a line 986 tangent to the outer side, drawn from the outer side 921 at the front side of the groove to the outer side at the back side 924 of the groove. In some embodiments, a base of a groove may be curved, where the line tangent to the base side of the groove may be drawn at the lowest point of the groove. Similar measurements can be made for any tooth or groove of either body.

The groove depth may be measured from the base side 923 of a groove at the same axial position that a corresponding tooth height measurement is taken along the tooth top side 903 when the connector 900 is assembled around and connected to the body 920. In other words, a tooth height 951 and groove depth 981 may be measured when the connector 900 is in connected position with a body 920 and at an axially shared position along the base side 923 of the groove and top side 903 of the tooth in a tooth/groove pair.

Figure 10:
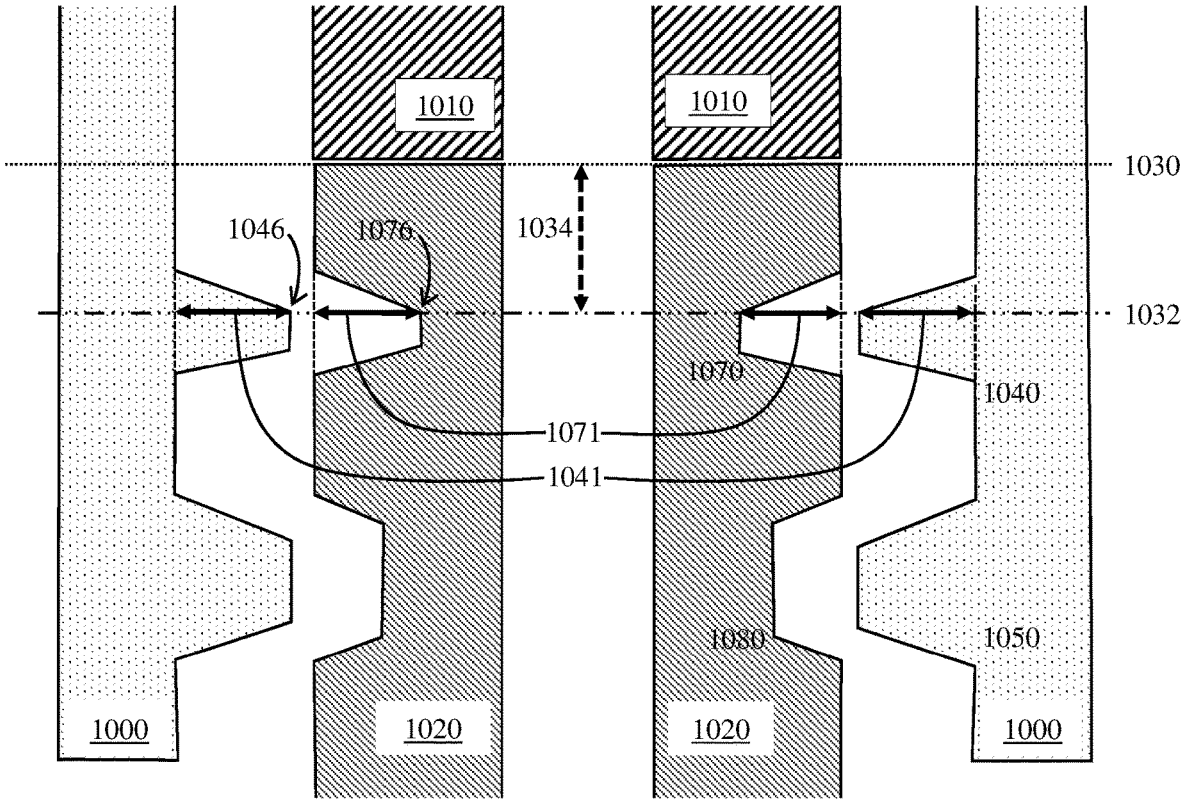
FIG. 10 depicts a cross section, according to some embodiments, of a connector, a first body, and a second body.

FIG. 10 depicts a cross section of some embodiments of a connector 1000, a first body 1020, and a second body 1010, relative to an axial center 1030 and a first radial plane 1032 drawn at an axial measurement distance 1034 from the axial center. A first tooth 1040 and a last/second tooth 1050 and the corresponding first groove 1070 and last/second groove 1080 are labeled, as well. A first tooth height 1041 of the first tooth 1040 and a first groove depth 1071 of a first groove 1070 may be measured as discussed above, where the height of the first tooth and the depth of the first groove are measured at axially consistent locations when the connector is assembled around the first body 1020. Put another way, both the first tooth height 1041 and the first groove depth 1071 may be measured at a constant axial measurement distance 1034 from the axial center 1030 of the connector 1000 when the connector is assembled around the first body 1020.

Figure 18:
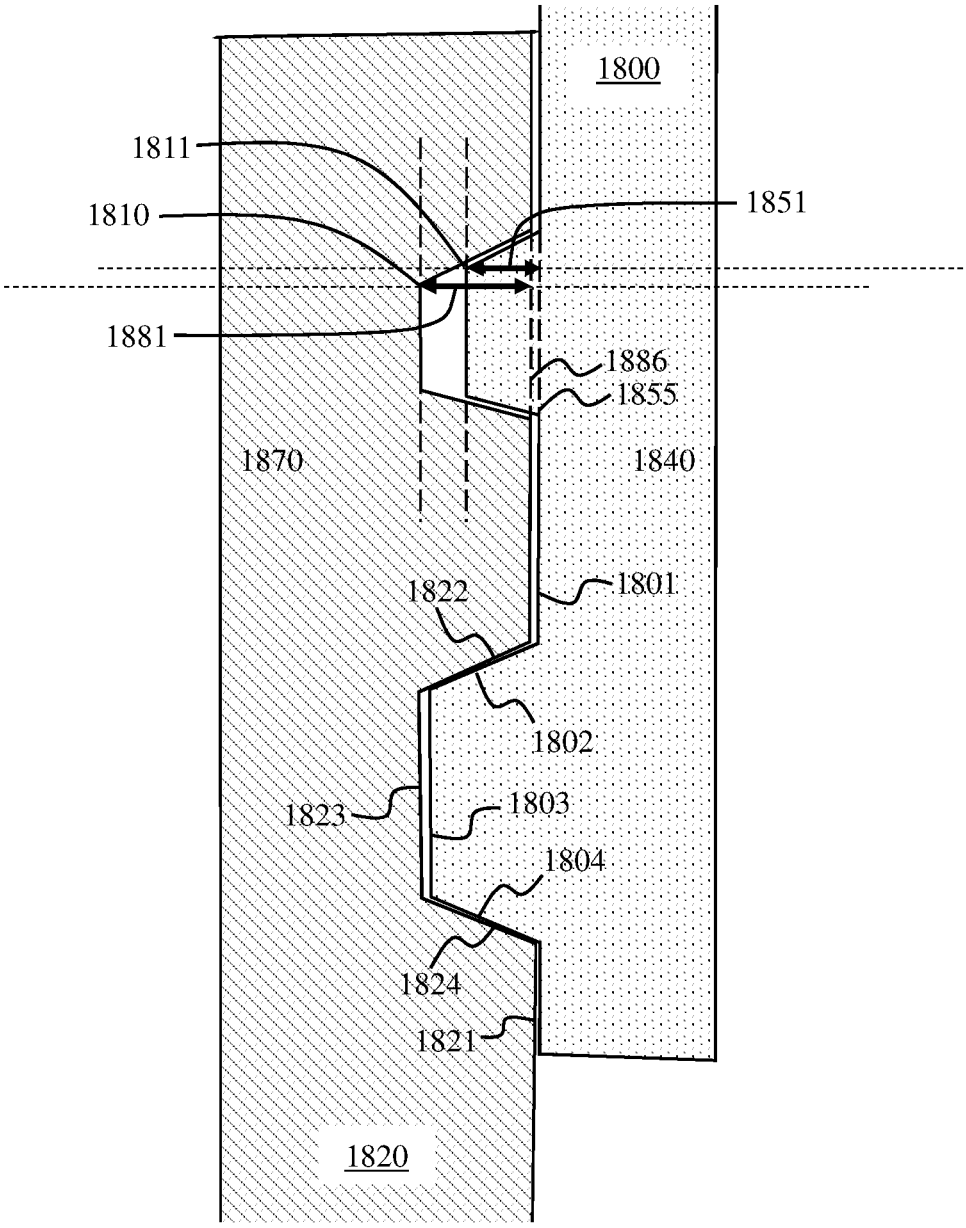
FIGS. 18-19 show a partial cross sectional view of connectors having multiple teeth in connected configuration with a body according to one or more embodiments of the present disclosure.

In some embodiments, when a connector is assembled around and connected to a body, a tooth height and groove depth may be measured at the same point along the tooth and groove, whether or not the points share an axial position. For example, as shown in FIG. 18, a tooth height 1851 may be measured between a base 1855 of the tooth and the intersection 1811 of the tooth's leading side 1802 and top side 1803. A groove depth 1881 may be measured between a groove top 1886 of the groove and the intersection 1810 of the groove's base side 1823 and front side 1822. The tooth base 1855 may be along a line tangent to and extending between the adjacent inner sides 1801 of the tooth, and the groove top 1886 may be along a line tangent to adjacent outer sides 1821 of the groove. As shown, the intersections 1810, 1811 of the groove and tooth in a tooth/groove pair at which the corresponding groove depth and tooth height may be measured do not share an axial position when the connector 1800 is in the connected configuration around the body 1820.

A tooth and groove in a tooth/groove pair may have a tooth height and a groove depth that is approximately the same or that is different. In embodiments where a tooth height is equal to or larger than a corresponding groove depth, the top side of the tooth may contact the base of the corresponding groove when the connector is assembled around the grooves. For example, as shown in FIG. 10, the inside of the connector 1000 at a measurement point 1046 on the first tooth 1040 may be nominally in contact with the first body 1020 at a measurement point 1076 on the first groove 1070.

Making the teeth taller than the groove depth within a tooth/groove pair may be a way to engineer the load transfer characteristics of the connecting assembly to help improve load transfer and decrease failure frequency. In some embodiments, within a tooth/groove pair, the tooth height of the tooth may be greater than the groove height of the groove. FIG. 10 depicts one such an embodiment (i.e., the first tooth height 1046 is larger than the first groove depth 1076). Furthermore, in some embodiments, all of the teeth will have larger heights than their corresponding grooves have depths within each tooth/groove pair.

In embodiments where a tooth height is less than a corresponding groove depth, the top side of the tooth may not contact the base of the corresponding groove when the connector is assembled around the grooves. For example, as shown in FIG. 18, the inside of the connector 1800 at a first tooth 1840 does not contact the outside of the first body 1820 at a first groove 1870.

Making the teeth shorter than the groove depth within a tooth/groove pair may be a way to engineer the load transfer characteristics of the connecting assembly to help improve load transfer and decrease failure frequency. In some embodiments, within a tooth/groove pair, the tooth height of the tooth may be less than the groove height of the groove. FIG. 18 depicts one such an embodiment (i.e., the first tooth height 1851 is smaller than the first groove depth 1881). Furthermore, in some embodiments, all of the teeth will have smaller or equal heights than their corresponding grooves have depths within each tooth/groove pair.

Figure 11:
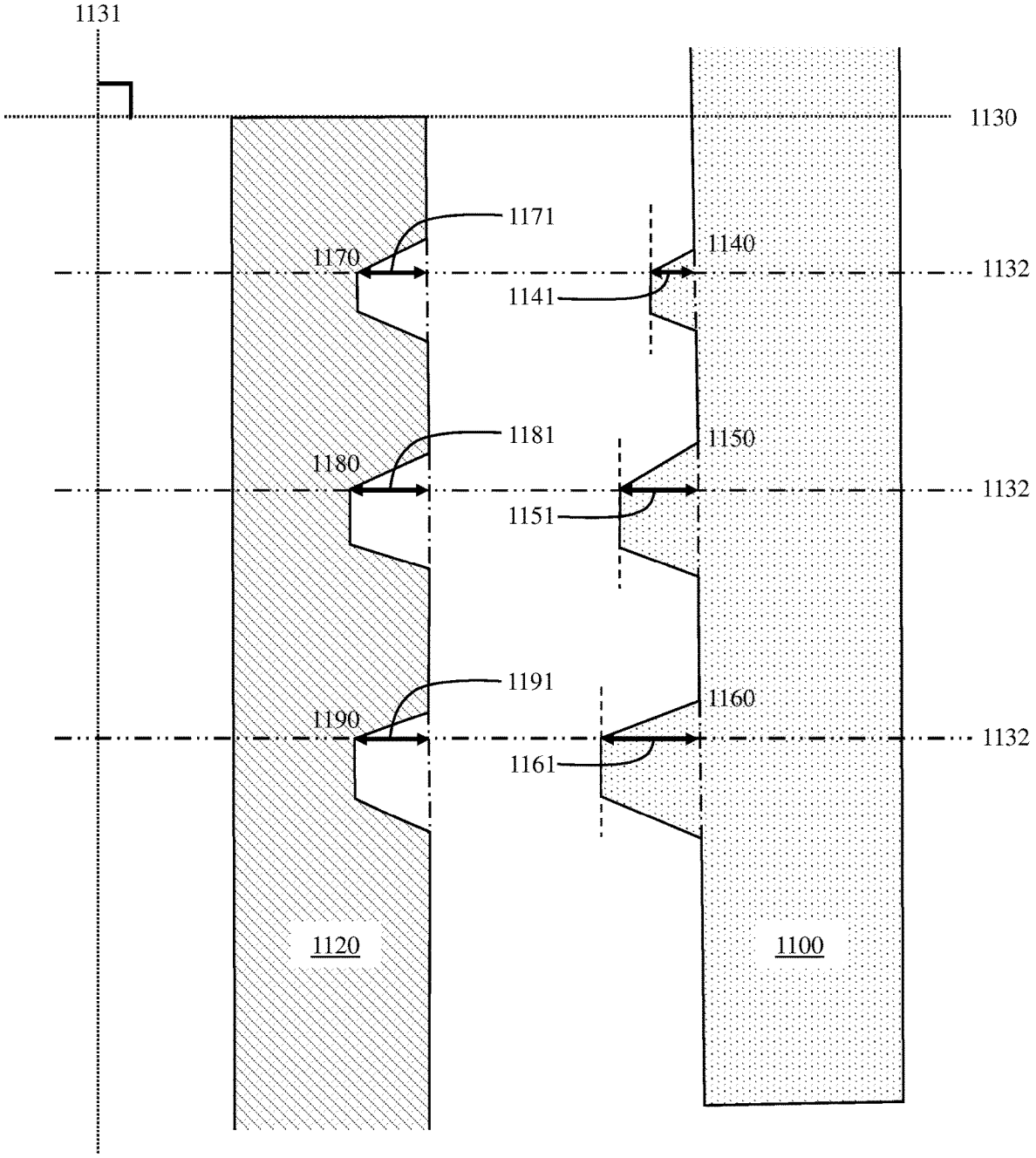
FIG. 11 shows a connector and a first body, having tooth/groove pairs, according to some embodiments of the present disclosure.

FIG. 11 depicts a partial cross sectional view of a connector 1100 having a first tooth 1140, a second tooth 1150, and a third tooth 1160 and a first body 1120 having a first groove 1170, a second groove 1180, and a third groove 1190. Tooth heights 1141, 1151, 1161 and groove depths 1171, 1181, 1191 are depicted for each tooth/groove pair. An axial center 1130, a centerline 1131, and three radial planes 1132 are included in FIG. 11 to aide in orienting the partial cross sections depicted here relative to the device as a whole. The centerline 1131 may be orthogonal to the axial center 1130. In this embodiment, the groove depths 1171, 1181, 1191 may be substantially equal, while the tooth heights may be different from each other. Alternatively, the groove depths

1171, 1181, 1191 may not be substantially equal as dictated by the first body to be connected to. As shown, the first tooth height 1141 is less than the first groove depth 1171, the second tooth height 1151 is equal to the second groove depth 1181, and the third tooth height 1161 is greater than the third groove depth 1191. In FIG. 11, according to one or more embodiments, the tooth and groove heights within each tooth/groove pair are measured at the same axial alignment (i.e., along the same radial plane) at a transition between a leading side and a top side of the tooth that matches a transition between a front side and a base side of the groove. Furthermore, in this embodiment, the front side of the groove and the leading side of the tooth are parallel.

In some embodiments, the first tooth height, the second tooth height, and the third tooth height (and further) may be nominally equivalent. Alternatively, the first, second, and third teeth (and further) may have varied tooth heights. In an embodiment with at least three teeth, the tooth height of at least two teeth may be nominally equal while the tooth heights of other teeth may be unequal (e.g., teeth two and three have equal tooth heights, while tooth one may have a different tooth height). In some embodiments, the tooth height for all teeth may be different. Finally, some embodiments may have some other mixture of equal and unequal tooth heights.

According to embodiments of the present disclosure, at least two tooth/groove pairs in a connecting assembly may have a difference between tooth height and groove depth that are unequal. For example, in the embodiment shown in FIG. 11, a first tooth/groove pair in a connecting assembly may have a difference between tooth height 1141 and groove depth 1171 that is less than the difference between the tooth height 1151 and groove depth 1181 in a second tooth/groove pair.

Another way to transfer the load between a connector and a first and/or second body may include altering tooth and/or groove angles by designing the teeth and/or grooves to have different angles between one or more sides of the tooth and/or groove. Because the profile of a tooth and/or groove may include one or more curved transitions, angles between the sides of a tooth and/or groove may be measured between lines tangent to the sides along the portion of the side having the longest consistent slope. Tooth angles may be altered relative to other teeth on a jaw and/or may be altered relative to the angles of corresponding grooves.

Figure 12:
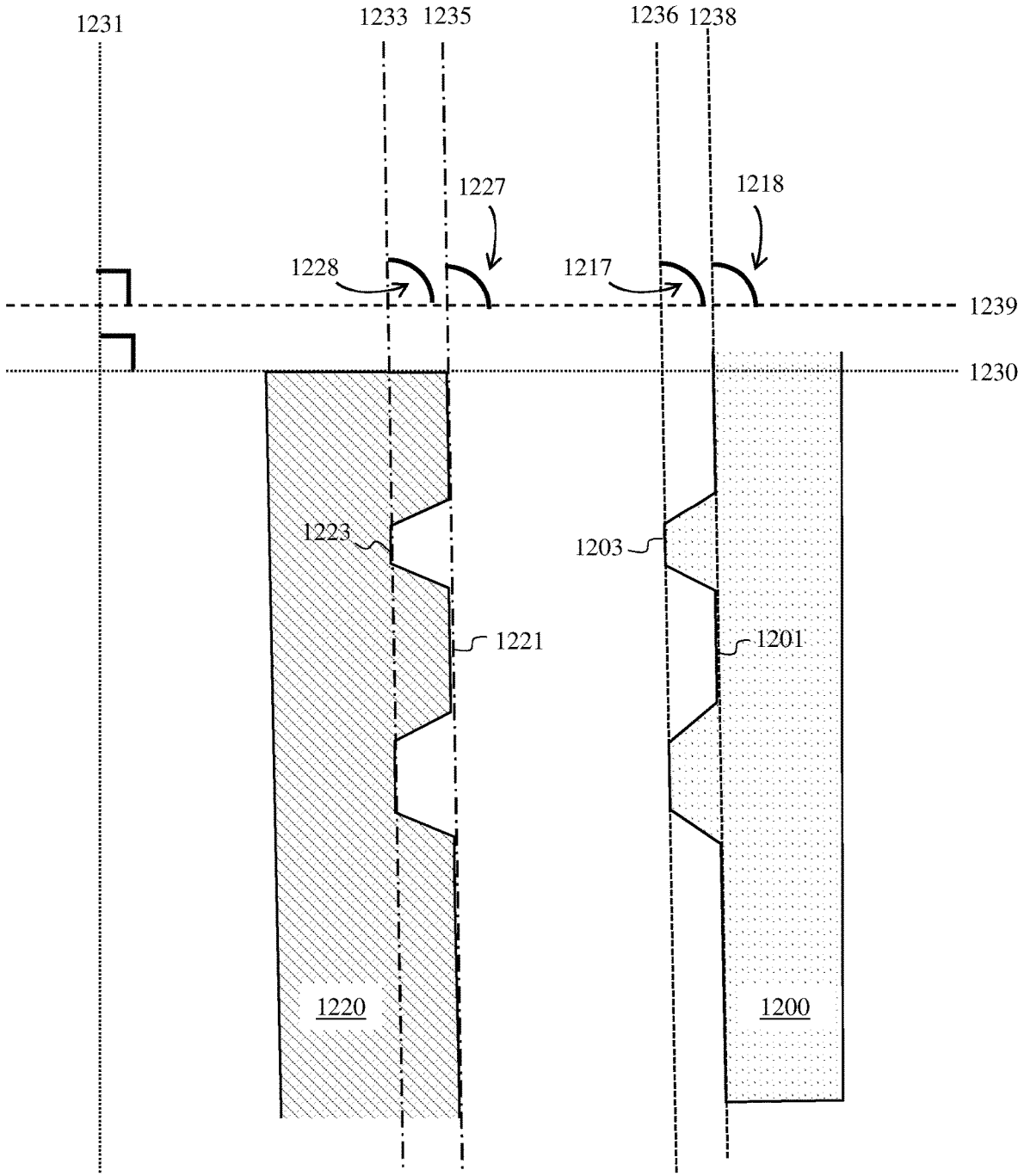
FIG. 12 shows a partial cross sectional view of a first body and a connector with angular measurements relative to a radial plane according to some embodiments of the present disclosure.

Referring now to FIG. 12, FIG. 12 depicts a partial cross sectional view of a first body 1220 and a connector 1200 with measurements relative to a radial plane along an axial middle 1230 of the connector 1200 when the connector and first body are axially aligned for connection. The radial plane is perpendicular to a central longitudinal axis (centerline) of the connector 1200, where the central longitudinal axis of the connector may be coaxial with a central longitudinal axis (centerline) of the body 1220 when the connector and body are assembled. A centerline 1231 is also illustrated, which may be disposed through a center of a channel through which fluid may flow within the first body 1220. The centerline 1231 may be orthogonal to the axial center 1230. Also depicted is a line tangent 1233 to a base side 1223 of a groove of the first body, a line tangent 1235 to an outer side 1221 of the first body, a line tangent 1236 to the top side 1203 of a tooth, and a line tangent to an inner side 1201 of the connector. A tooth taper angle 1217 may be measured between the radial plane 1239 and the line tangent 1236 to the top side 1203 of a tooth. A tooth outer taper angle 1218 may be measured between the radial plane 1239 and the line tangent 1238 to the inner side 1201 of a connector. Similarly, a groove outer taper angle 1227 may be measured between the radial plane 1239 and the line tangent 1235 to an outer side 1221 of the first body. Finally, a groove taper angle 1228 may be measured between the radial plane 1239 and the line tangent 1233 to the base side 1223 of the groove.

In some embodiments, the tooth taper angle 1217 and the tooth outer taper angle 1218 may be equivalent. In some embodiments, the tooth taper angle 1217 and the tooth outer taper angle 1218 may not be equivalent. In some embodiments, the groove taper angle 1228 and the groove outer taper angle 1227 may be equivalent. In some embodiments, the groove taper angle 1228 and the groove outer taper angle 1227 may not be equivalent. In some embodiments, all four angles may be greater than or equal to 90°.

In some embodiments, the tooth taper angle and the groove taper angle may not be equivalent. In some embodiments, the tooth taper angle 1217 may be greater than the groove taper angle. Further, the tooth taper angle 1217 may be greater than the groove taper angle by 0.25° or more (e.g., 0.5° or more, 0.75° or more, 1.0° or more, 1.25° or more, 1.5° or more, etc.). In some embodiments, the tooth taper angle 1217 may be less than the groove outer taper angle 1227. Further, the tooth taper angle 1217 may be less than the groove outer taper angle 1227 by 0.25° or more (e.g., 0.5° or more, 0.75° or more, 1.0° or more, 1.25° or more, 1.5° or more, etc.).

In some embodiments, at least one of the tooth taper angle or the tooth outer taper angle may be less than at least one of the groove outer taper angle or the groove taper angle. Further, the tooth taper angle or the tooth outer taper angle may be less than the groove taper angle or groove outer taper angle by 0.25° or more (e.g., 0.5° or more, 0.75° or more, 1.0° or more, 1.25° or more, 1.5° or more, etc.). In some embodiments, at least one of the tooth taper angle or the tooth outer taper angle may be greater than at least one of the groove outer taper angle or the groove taper angle. Further, the tooth taper angle or the tooth outer taper angle may be greater than the groove taper angle or groove outer taper angle by 0.25° or more (e.g., 0.5° or more, 0.75° or more, 1.0° or more, 1.25° or more, 1.5° or more, etc.).

In the embodiment shown, the tooth taper angle 1217 may be equal for each of the teeth in a jaw. In other embodiments, at least one tooth may have a tooth taper angle different from at least one other tooth in the same jaw, as depicted in FIG. 13, below.

Figure 13:
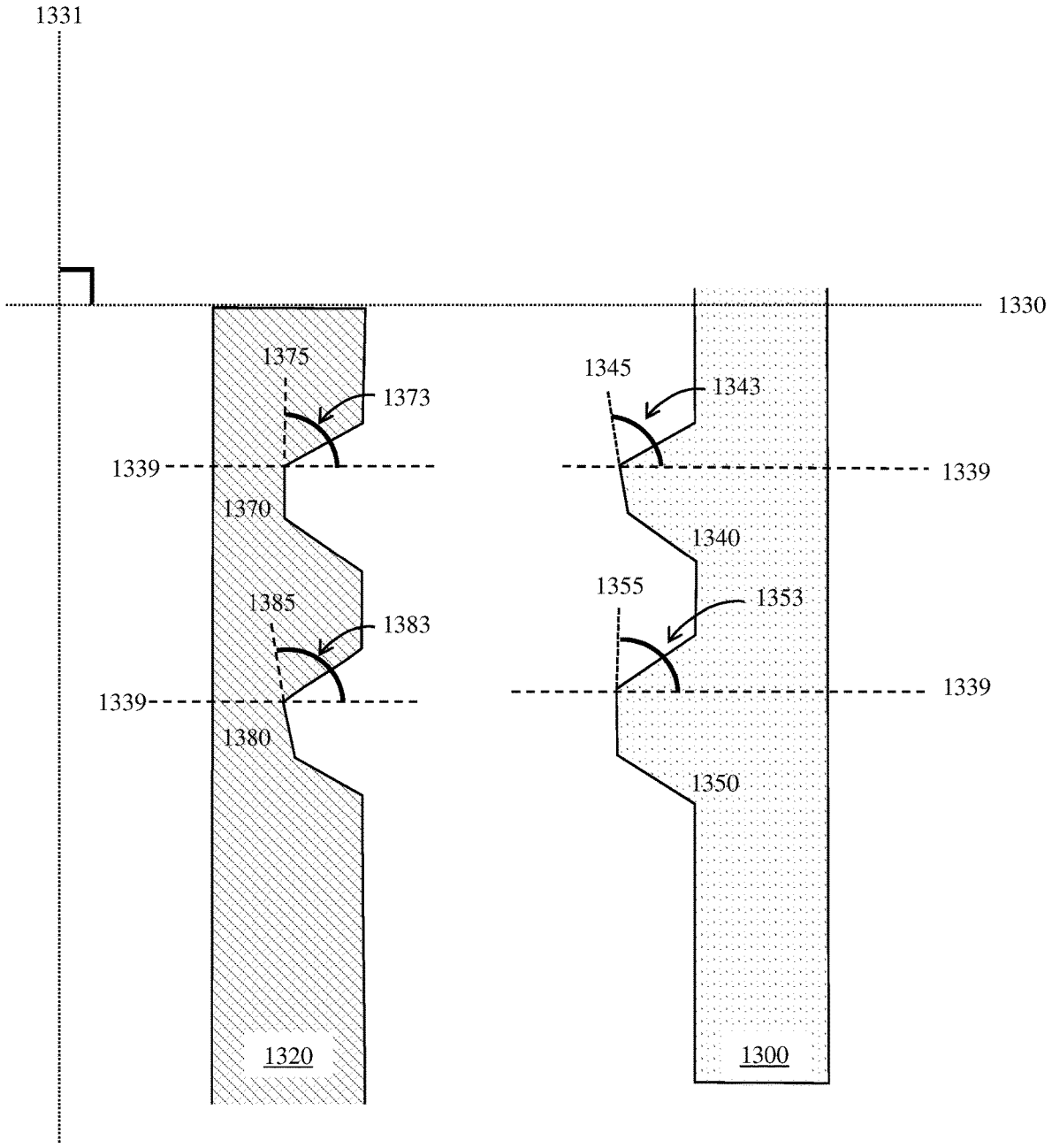
FIG. 13 depicts a partial cross sectional view of a connector having multiple teeth according to some embodiments of the present disclosure.

For example, referring now to FIG. 13, FIG. 13 depicts a partial cross sectional view of a connector 1300 having a first tooth 1340 and a second tooth 1350 with different tooth taper angles according to one or more embodiment. It also depicts a first body 1320 having a first groove 1370 and a second groove 1380 with different groove taper angles. A number of reference lines are depicted: an axial center 1330; a centerline 1331; radial planes 1339; a first top side tangent 1345; and a second top side tangent 1355. A first tooth taper angle 1343 may be measured between the radial plane 1339 and the first top side tangent 1345. Similarly, a second tooth taper angle 1353 may be measured between the radial plane 1339 and the second top side tangent 1355. A first groove taper angle 1373 and a second groove taper angle 1383 are similarly measured between the radial plane 1339 and a first base side 1375 and between the radial plane 1339 and a second base side 1385, respectively. The first tooth taper angle 1343 and the second tooth taper angle 1353 may be measured when the connector is oriented parallel to the first body as if it is connected. This may help ensure the angles may be properly compared with the geometry of the grooves of the first and/or second body.

In some embodiments, the first tooth taper angle and the second tooth taper angle (and further) may be nominally equivalent. Alternatively, the first and second teeth (and further) may have varied tooth taper angles. In an embodiment with at least three teeth, the tooth taper angles of at least two teeth may be nominally equal while the tooth taper angles of other teeth may be unequal (e.g., teeth two and three have equal tooth taper angles, while tooth one may have a different tooth taper angle). In some embodiments, the tooth taper angle for all teeth may be different. Finally, some embodiments may have some other mixture of equal and unequal tooth taper angles.

Furthermore, equal and/or unequal tooth taper angles may be used in combination with equal and/or unequal tooth heights. For example, a jaw may have teeth with equal or unequal tooth taper angles and equal or unequal tooth heights designed in a manner to optimize load transfer from the connector to the first and/or second body. One such embodiment is discussed below.

Figure 14:
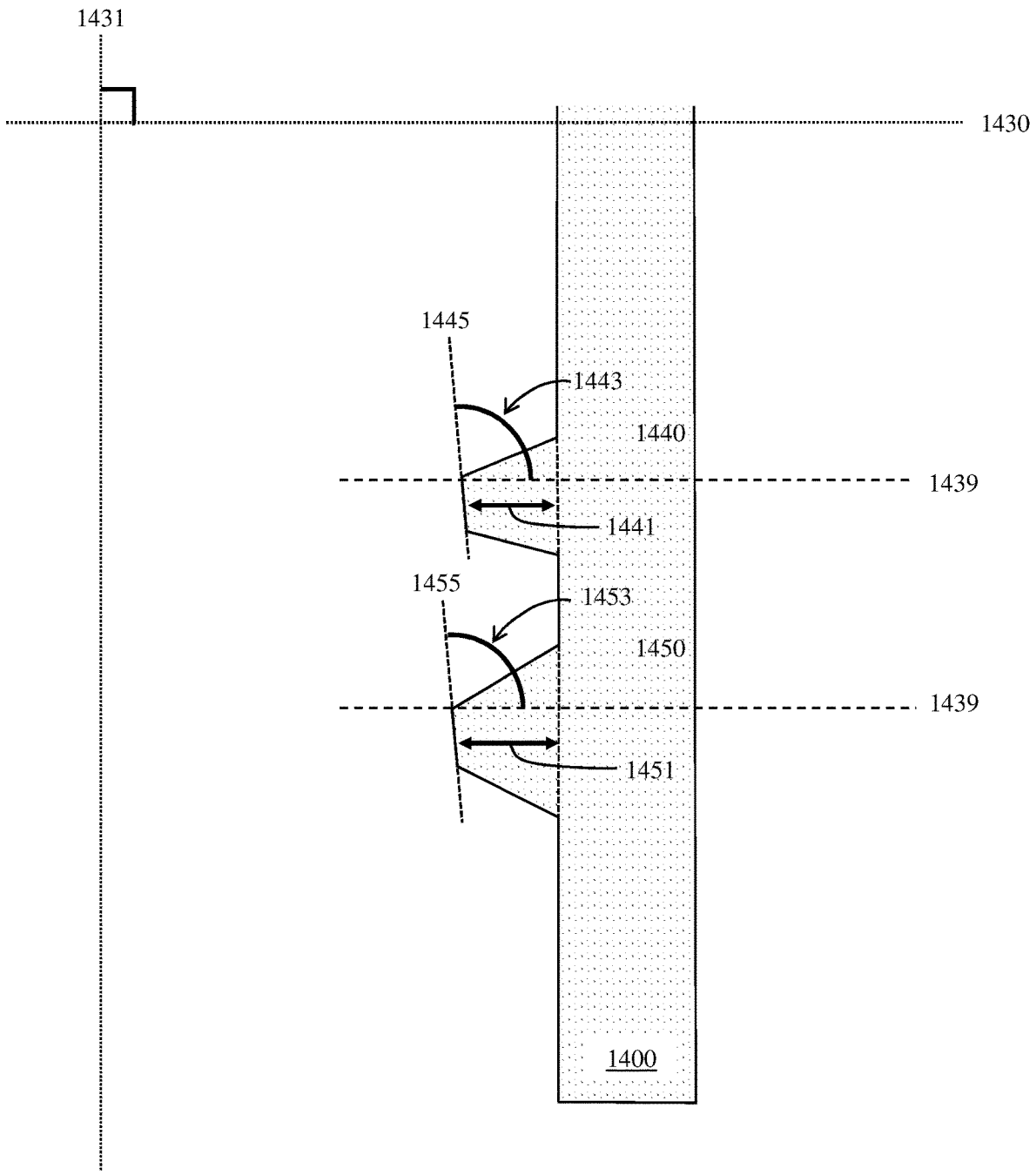
FIGS. 14-17 depict one or more embodiments of the present disclosure that include a connector having teeth and a first body having grooves.

In one or more embodiments, as depicted in FIG. 13, the first tooth taper angle and the second tooth taper angle may be different. In such a case, the top surfaces of the first and second teeth may not be collinear. In some embodiments, at least two tooth taper angles (e.g., the first tooth taper angle and the second tooth taper angle) may be equivalent, while the tooth heights may be different (e.g., the first tooth height may be less than the second tooth height), as depicted in FIG. 14 below. In other embodiments, the tooth heights and the tooth taper angles of all teeth may be nominally equal, as depicted in FIG. 12 above. In such a case, all teeth may be nominally collinear.

The groove taper angles may be an important factor to consider for the design herein. For some first and/or second bodies, the first groove taper angle and the second groove taper angle (and further) may be nominally equivalent. Historically, equal groove taper angles have been the most common configuration. Alternatively, the first and second grooves (and further) may have varied groove taper angles. In some connectors with at least three grooves, the groove taper angle of at least two grooves may be nominally equal while the groove taper angles of other grooves may be unequal (e.g., grooves two and three have equal groove taper angles, while groove one may have a different groove taper angle). In some embodiments, the groove taper angle for all grooves may be different. Finally, some embodiments may have some other mixture of equal and unequal groove taper angle.

Having the tooth taper angle not equal to the groove taper angle within the tooth/groove pair may be one method to alter the contacting surfaces, thus changing how load is transferred between the connector and the first and/or second body. In some embodiments, the tooth taper angle of a tooth may match the groove taper angle of a groove within a tooth/groove pair. Alternatively, in some embodiments, the tooth taper angle of the tooth may not be equal to the groove taper angle of the groove within the tooth groove pair. This embodiment is depicted in FIG. 13, where the first tooth taper angle 1343 is not equal to the first groove taper angle 1373 and the second tooth taper angle 1353 is not equal to the second groove taper angle 1383. Note when the tooth and the groove have unequal taper angles (as in the first tooth/groove pair of FIG. 13), measuring a tooth height and a groove depth at an axially-equivalent location when the connector is in a connected configuration with the body may be important.

In some embodiments, the tooth taper angle may be greater than the groove taper angle for at least one tooth/groove pair. In some embodiments, the tooth taper angle may be less than the groove taper angle for at least one tooth/groove pair. It is also possible for at least one tooth/groove pair to have equivalent tooth and groove taper angles, while at least one alternative tooth/groove pair have non-equivalent tooth and groove taper angles (with the tooth taper angle(s) being either greater or less than the groove taper angle(s)).

Furthermore, the angles of the contacting surfaces of one or more teeth/grooves may be altered. Contacting surfaces between a tooth/groove pair may include surfaces between which a load is transferred between the connector and the body being connected. For example, the contacting surfaces may include a leading side of a tooth and a front side of a corresponding groove, where force may be transferred between the two surfaces during and/or after connecting the connector to the body.

For example, referring now to FIG. 14, FIG. 14 depicts a partial cross sectional view of a connector 1400 having a first tooth 1440 and a second tooth 1450 with roughly equivalent tooth taper angles but different tooth heights according to one or more embodiment. A number of reference lines are depicted: an axial center 1430; a centerline 1431; radial planes 1439; a first top side tangent 1445; and a second top side tangent 1455. A first tooth taper angle 1443 may be measured between the radial plane 1439 and the first top side tangent 1445. Similarly, a second tooth taper angle 1453 may be measured between the radial plane 1439 and the second top side tangent 1455. A first tooth height 1441 and a second tooth height 1451 may be measured as discussed above. In the one or more embodiments depicted in FIG. 14, the first and second tooth taper angles 1443, 1453 may be nominally equivalent, while the first and second tooth heights 1441, 1451 may not be equivalent. Such a connector may have teeth that are not colinear. The first and second tooth taper angles 1443, 1453 and the first and second tooth heights 1441, 1451 may be measured when the connector is oriented parallel to the first body as if it is connected. This may help ensure the angles and heights may be properly compared with the geometry of the grooves of the first and/or second body.

In some embodiments, the first tooth height 1441 may be less than the second tooth height 1451, as depicted in FIG. 14. In some other embodiments, the first tooth height 1441 may be greater than the second tooth height 1451. In further embodiments, the connector may have more than two teeth in the first jaw, e.g., three teeth, four teeth, five teeth, six teeth, or more. The first jaw may include, in some embodiments, three or more teeth, where all the teeth have roughly equivalent tooth taper angles but at least two different tooth heights. In one or more embodiments, the first tooth height may be less than the tooth height of the remaining teeth (i.e., the second tooth, a third tooth, etc.). Further, the tooth heights of the remaining teeth may or may not be roughly equivalent to one another. In one or more such embodiments, the first tooth height may be less than the second tooth height, while the tooth height of all subsequent teeth may be roughly equivalent to the second tooth height. Alternatively, in one or more embodiments, the first tooth height may be less than the second tooth height, the second tooth height may be less than a third tooth height, and the third tooth height may be less than a fourth tooth height, and so on. In some embodiments, each tooth in a jaw may have a different tooth height, where the difference in tooth height does not follow a pattern.

Figure 15:
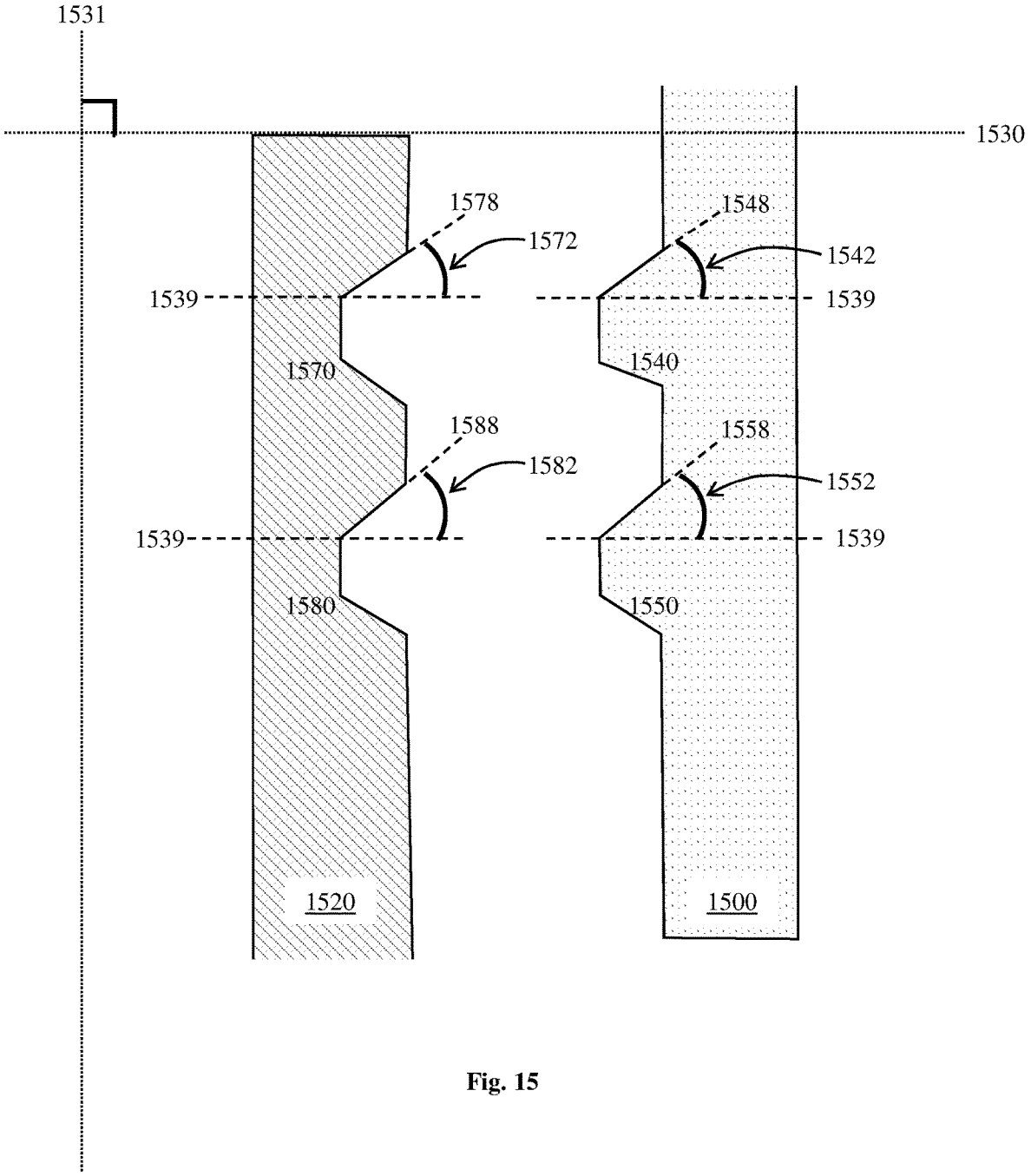

Referring now to FIG. 15, FIG. 15 depicts one or more embodiments that include a connector 1500 (having a first and second tooth 1540, 1550) and a first body 1520 (having a first and second groove 1570, 1580) in relation to an axial center 1530 and a centerline 1531 when the connector is aligned axially with the first body 1520 for connection. For the first tooth 1540, a first tooth leading angle 1542 may be measured between a radial plane 1539 and a first leading side tangent 1548. A line 1548 tangent to the leading side of the tooth may be drawn tangent to the portion of the leading side having the longest uniform slope. For example, in embodiments having curved transitions at the top side-leading side transition and/or the leading side-base transition with a substantially planar leading side extending between the two transitions, the line tangent to the leading side may be drawn tangent to the planar portion extending between the two curved transitions. The radial plane 1539 may be perpendicular to the central longitudinal axis of the connector when assembled. Similarly, the second tooth 1550 may have a second tooth leading angle 1552 that may be measured between the radial plane 1539 and a second leading side tangent 1558. The first and second leading tooth angles 1542, 1552 may be measured when the connector is oriented parallel to the first body as if it is connected. This may help ensure the angles may be properly compared with the geometry of the grooves of the first and/or second body.

For the first groove 1570, a first groove front angle 1572 may be measured between the radial plane 1539 and a first groove front surface tangent 1578. As described above with respect to tangent lines along a tooth surface, a line 1578 tangent to the front surface of a groove may be drawn along the portion of the surface having the longest uniform slope (e.g., a planar portion between transitions to adjacent groove surfaces). Finally, the second groove 1580 may have a second groove front angle 1582 that may be measured between the radial plane 1539 and a second groove front surface tangent 1588. One having skill in the art will realize that, assuming all represented radial planes 1539 are parallel, the multiple angles may be measured correctly between the radial planes 1539 as depicted at multiple axial locations and the appropriate line (e.g., the first leading side tangent 1548).

The groove front angle may be an important factor to consider when designing tooth configurations on a connector, as described herein. For some first and/or second bodies, the first groove front angle and the second groove front angle (and further) may be nominally equivalent. Historically, equal groove front angles have been the most common configuration. Alternatively, the first and second grooves (and further) may have varied groove front angles. In some connectors with at least three grooves, the groove front angle of at least two grooves may be nominally equal while the groove front angle of other grooves may be unequal (e.g., grooves two and three have equal groove front angles, while groove one may have a different groove front angle). In some embodiments, the groove front angle for all grooves may be different. Finally, some embodiments may have some other mixture of equal and unequal groove front angle.

Furthermore, the angles of the contacting surfaces of one or more teeth/grooves may be altered. Contacting surfaces between a tooth/groove pair may include surfaces between which a load is transferred between the connector and the body being connected. For example, the contacting surfaces may include a leading side of a tooth and a front side of a corresponding groove, where force may be transferred between the two surfaces during and/or after connecting the connector to the body Having the tooth leading angle that is not equal to the groove front angle within the tooth/groove pair may be one method to alter the contacting surfaces, thus changing how load is transferred between the connector and the first and/or second body. In some embodiments, the tooth leading angle of a tooth may match the groove front angle of a groove within a tooth/groove pair. Looking to FIG. 15 for example, this would mean that the first tooth leading angle 1542 may be nominally equivalent to the first groove front angle 1572. Similarly, the second tooth leading angle 1552 may be nominally equivalent to the first groove front angle 1582. Alternatively, in some embodiments, the tooth leading angle of the tooth may not be equal to the groove front angle of the groove within the tooth groove pair. For example, a first tooth leading angle may not be equal to a corresponding first groove front angle, and/or a second tooth leading angle may not be equal to a corresponding second groove front angle 1582.

In some embodiments, the tooth leading angle may be greater than the groove front angle for at least one tooth/groove pair. In some embodiments, the tooth leading angle may be less than the groove front angle for at least one tooth/groove pair. It is also possible for at least one tooth/groove pair to have the tooth leading angle equal the groove front angle, while at least one alternative tooth/groove pair have the tooth leading angle not equal the groove front angle (with the tooth leading angle(s) being either greater or less than the groove front angle(s)). In some embodiments, within a tooth/groove pair, the tooth leading angle may be less than the groove front angle. For instance, in some embodiments, a first tooth leading angle may be less than the first groove front angle. In some embodiments, within a tooth/groove pair, the tooth leading angle may be less than the groove front angle by at least 0.05° (e.g., at least 0.10°, at least 0.15°, at least 0.20°, at least 0.25°, at least 0.5°, at least 0.75°, at least 1.0°, at least 1.25°, at least 1.5°, at least 2°, at least 2.5°, at least 3°, at least 4°, at least 5°, etc.).

Figure 16:
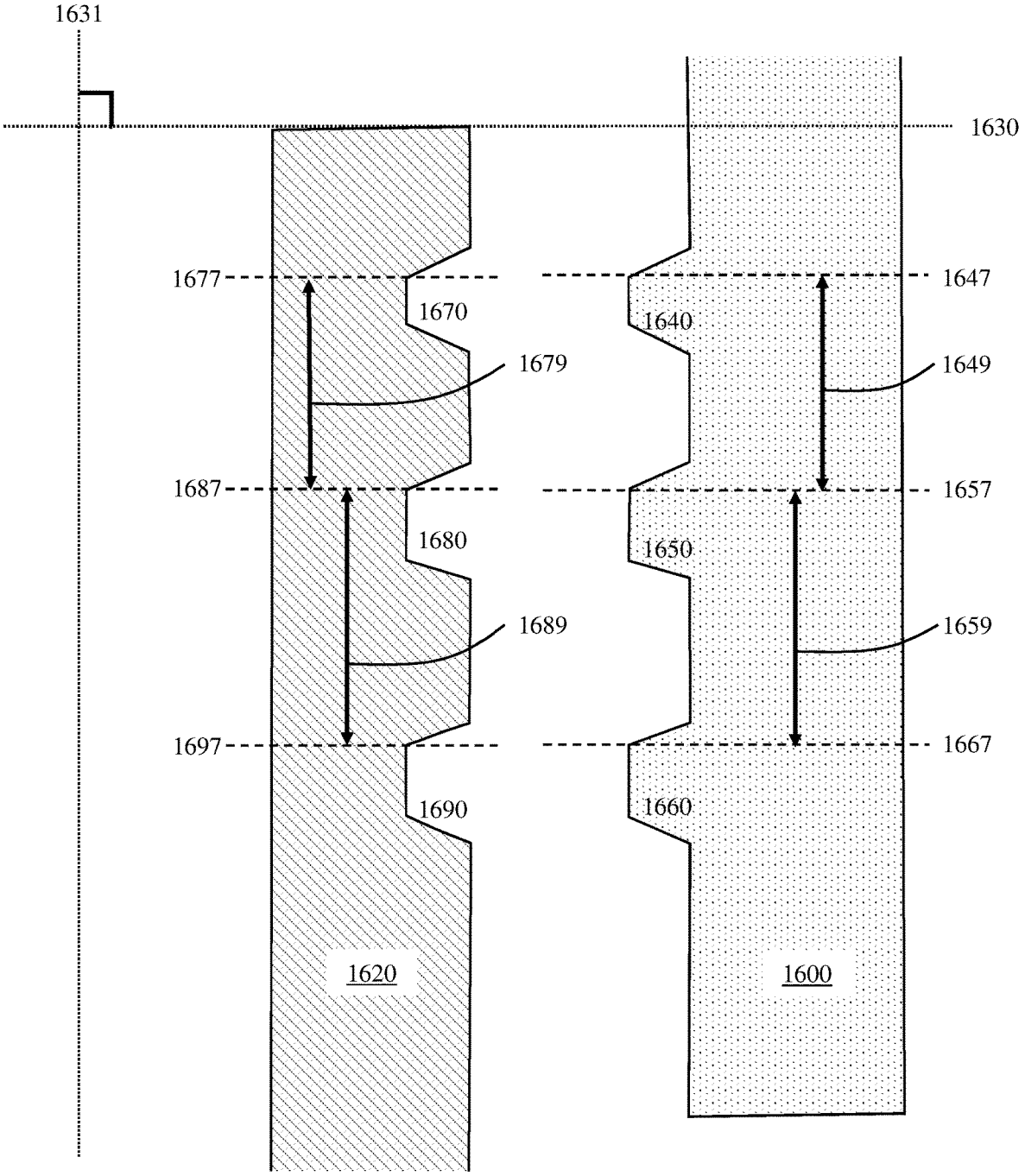

FIG. 16 depicts a partial cross sectional view of a connector 1600 and a first body 1620 shown in relation to an axial center 1630 and a centerline 1631 when the connector 1600 is axially aligned with the first body 1620 for interlocking the teeth with the corresponding grooves. The connector has a first tooth 1640, a second tooth 1650, and a third tooth 1660. The first body has a first groove 1670, a second groove 1680, and a third groove 1690. A first axial tooth spacing 1649 may be measured between a horizontal bisector of the first tooth 1647 and a horizontal bisector of the second tooth 1657, where the horizontal bisectors extend along radial planes perpendicular to a central longitudinal axis of the connector 1600 and bisect the teeth at the transition between the leading side and top side of the teeth. Similarly, a second axial tooth spacing 1659 may be measured between the horizontal bisector of the second tooth 1657 and a horizontal bisector of the third tooth 1667. The first and second axial tooth spacings 1649, 1659 may be measured when the connector is oriented parallel to the first body as if it is connected. This may help ensure the lengths may be properly compared with the geometry of the grooves of the first and/or second body.

A first axial groove spacing 1679 may be measured between a horizontal bisector of the first groove 1677 and a horizontal bisector of the second groove 1687, where the horizontal bisectors extend along radial planes perpendicular to a central longitudinal axis of the first body 1620 and bisect the grooves at the transition between the front surface and base of the grooves. Similarly, a second axial groove spacing 1689 may be measured between the horizontal bisector of the second groove 1687 and a horizontal bisector of the third groove 1697.

Each of the horizontal bisectors for the teeth depicted in FIG. 16 are located between the leading side and the top side of the tooth, while each of the horizontal bisectors for the grooves depicted here are located between the leading side and the bottom side of the grooves. However, one having skill in the art will realize, as long as the positioning of the horizontal bisectors is equivalent along the profile of the multiple teeth/grooves, the measurements may precisely represent the tooth/groove spacing.

In some embodiments, the first axial groove spacing may equal the second axial groove spacing, which may equal all the axial groove spacing for any further grooves in the receiving profile (i.e., each of the grooves in the connecting end of a first body may be equally spaced along the first body). Alternatively, one or more axial groove spacings may vary (i.e., the grooves are not equally spaced along the first body). For example, a first and second groove spacing may be equivalent to each other, but different than a third groove spacing.

Axial groove spacings may be an important factor for the design herein. For some first and/or second bodies, the first axial groove spacing 1679 and the second axial groove spacing 1689 (and additional axial groove spacings not depicted) may be nominally equivalent. Historically, equal axial groove spacings within a single body have been the most common configuration. Alternatively, the first and second grooves (and further) may have varied axial groove spacing (i.e. the first axial groove spacing 1679 does not equal the second axial groove spacing 1689, etc.). In some connectors with at least three grooves, the axial groove spacing of at least two grooves may be nominally equal while the axial groove spacings of other grooves may be unequal (e.g., grooves two and three have equal axial groove spacing, while groove one may have a different axial groove spacing). In some embodiments, the axial groove spacing for all grooves may be different. Finally, some embodiments may have some other mixture of equal and unequal axial groove spacing.

In some embodiments, the first axial tooth spacing may equal the second axial tooth spacing, and may equal all the axial tooth spacing for any further teeth in the jaw (i.e., each of the teeth in a jaw may be equally spaced along the jaw of the connector). Alternatively, one or more axial tooth spacings may vary (i.e., the teeth are not equally spaced along the jaw of the connector).

In some embodiments, the axial tooth spacing of a tooth may match the axial groove spacing of a groove within a tooth/groove pair. Looking to FIG. 16 for example, this would mean that the first axial tooth spacing 1649 may be nominally equivalent to the first axial groove spacing 1679. Similarly, the second axial tooth spacing 1659 may be nominally equivalent to the first axial groove spacing 1689. Alternatively, having the axial tooth spacing that does not equal the axial groove spacing within the tooth/groove pair may be one additional method to alter the contacting surfaces, thus changing how load is transferred between the connector and the first and/or second body. Thus, in some embodiments, the axial tooth spacing of the tooth may not be equal to the axial groove spacing of the groove within the tooth groove pair. For example, in FIG. 16, the first axial tooth spacing 1649 may not be equal to the first axial groove spacing 1679. Similarly, the second axial tooth spacing 1659 may not be equal to the second axial groove spacing 1689. Embodiments disclosed herein may have the axial tooth spacing of each of the teeth nominally equal to the axial groove spacing of each of the grooves within all tooth/groove pairs in the connector. This embodiment may occur whether or not the axial groove spacings within the first and/or second body are internally equivalent (e.g., when the first axial groove spacing 1679 does not equal the second axial groove spacing 1689, etc.). Further, embodiments disclosed herein may have equivalent axial tooth and groove spacing for each tooth/groove pair in a connector in combination with one or more other tooth configurations disclosed herein, e.g., tooth taper angle, tooth height, and/or tooth leading side angle configurations described above.

Figure 17:
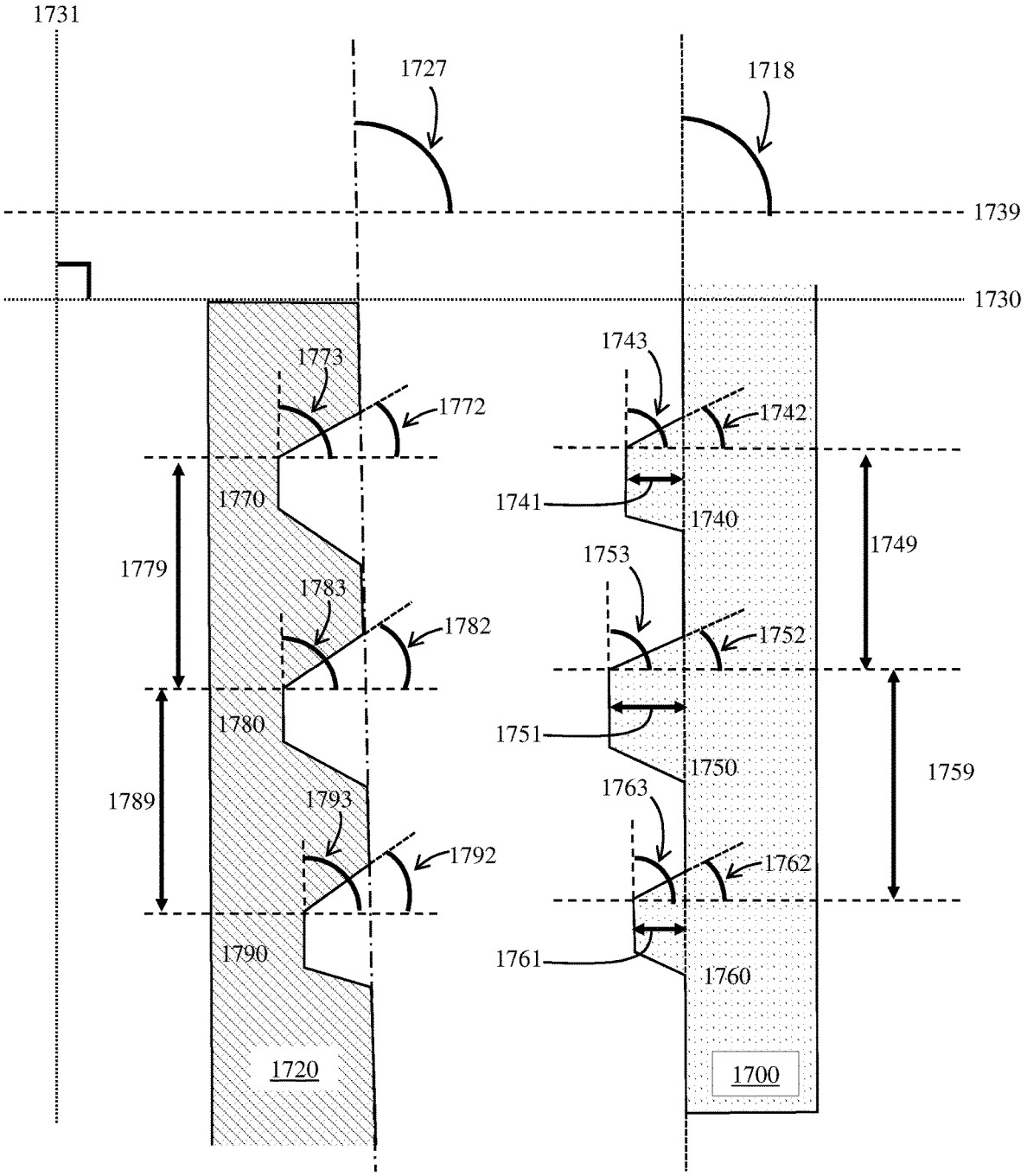

FIG. 17 depicts one embodiment combining multiple of the above features within one connector 1700 with a first, second, and third tooth 1740, 1750, 1760 for connecting to a first body 1720 with a first, second, and third groove 1770, 1780, 1790. An axial center 1730, a radial plane 1739, and a centerline 1731 are depicted for reference. Note: each of the angles/distances are measured as described above, but most of the reference lines are unlabeled here for clarity. The first, second, and third groove have a first, second, and third groove taper angle 1773, 1783, 1793, respectively. The first, second, and third groove taper angles (1773, 1783, 1793) may be nominally equivalent. The first body 1720 also has a first and second axial groove spacing 1779, 1789, which may or may not be nominally equivalent. The first second, and third groove also have a first, second, and third groove front angle 1772, 1782, 1792. The first, second, and third groove front angles (1772, 1782, 1792) may be nominally equivalent. Finally, the first body 1720 has a groove outer taper angle 1727. The groove outer taper angle 1727 may be nominally equivalent to the first, second, and third groove taper angles (1773, 1783, 1793).

Similarly, the first, second, and third tooth 1740, 1750, 1760 each have a first, second, and third tooth taper angle 1743, 1753, 1763; a first, second, and third tooth leading angle 1742, 1752, 1762; and a first, second, and third tooth height 1741, 1751, 1761, respectively. The connector 1700 also has a first and second axial tooth spacing 1749, 1749. Finally, the connector 1700 has a tooth inner taper angle 1718. The tooth taper angles 1743, 1753, 1763; tooth leading angles 1742, 1752, 1762; tooth heights 1741, 1751, 1761; and axial tooth spacings 1749, 1749 may all be measured when the connector is oriented parallel to the first body as if it is connected. This may help ensure the measurements may be properly compared with the geometry of the grooves of the first and/or second body.

The parameters of the first and/or second body are frequently set long before a particular connector is designed. The first body, thus, may have existing values for the axial groove spacing(s), groove taper angle(s), groove front angle(s), and groove outer taper angle. Therefore, embodiments of this disclosure may have various parameters of the connector set to properly transfer load between the first body and the second body. Specifically, embodiments of this disclosure describe controlling, at least, the values for the axial tooth spacing(s), tooth taper angle(s), tooth leading angle(s), and tooth outer taper angle. For example, one may set some parameters of the connector equal to those of the first body while setting other parameters unequal to those of the first body.

In one or more embodiments, the first, second, and third tooth taper angles (1743, 1753, 1763) may be nominally equivalent. Similarly, in one or more embodiments, the first, second, and third tooth leading angles (1742, 1752, 1762) may be nominally equivalent. In some embodiments, the tooth outer taper angle 1718 may be nominally equivalent to the first, second, and third tooth taper angles (1743, 1753, 1763). In some embodiments, this may be true for a connector having more than three teeth.

In one or more embodiments, the axial tooth spacing of a tooth may match the axial groove spacing of a groove within a tooth/groove pair. Looking to FIG. 17 for example, this would mean that the first axial tooth spacing 1749 may be nominally equivalent to the first axial groove spacing 1779. Similarly, the second axial tooth spacing 1759 may be nominally equivalent to the first axial groove spacing 1789. However, in one or more embodiments, the first, second, and third tooth taper angles (1743, 1753, 1763) may be less than the first, second, and third groove taper angles (1773, 1783, 1793). In one or more embodiments, first, second, and third tooth leading angles (1742, 1752, 1762) may be less than the first, second, and third groove front angles (1772, 1782, 1792). In some embodiments, the first, second, and third tooth heights 1741, 1751, 1761 may all be different. In some embodiments, when there are more than three teeth/grooves, the same equivalencies may still hold true for the grooves/teeth beyond the third.

Figure 19:
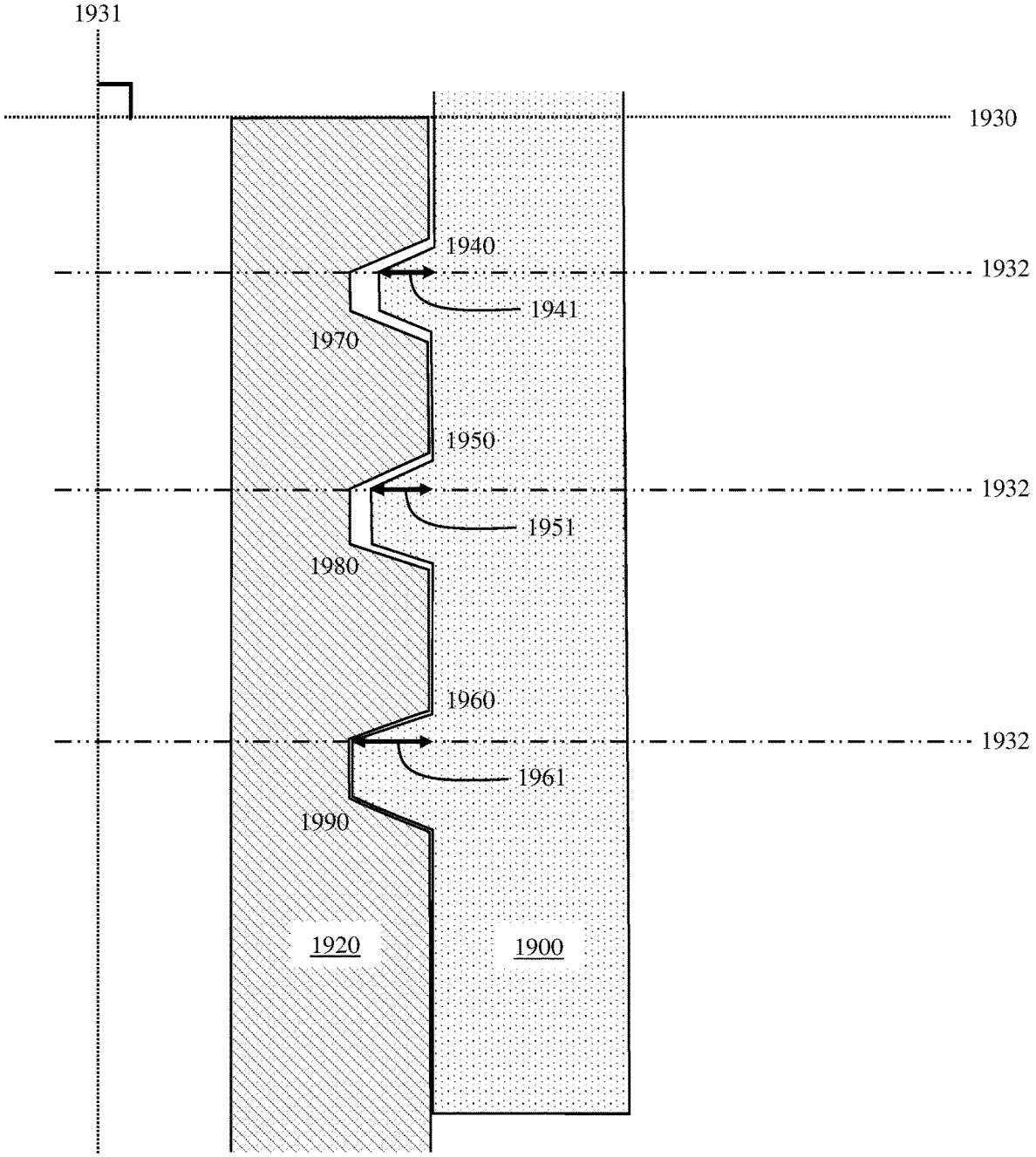

FIG. 19 depicts one embodiment combining multiple of the above features within one connector 1900 with a first, second, and third tooth 1940, 1950, 1960 for connecting to a first body 1920 with a first, second, and third groove 1970, 1980, 1990. An axial center 1930, three radial planes 1932, and a centerline 1931 are depicted for reference. Note: each of the angles/distances are measured as described above, but most of the reference lines are unlabeled here for clarity.

The first, second, and third teeth have a first, second, and third tooth height 1941, 1951, 1961, respectively. In FIG. 19. the depth of the first, second, and third grooves measured as discussed above are equivalent, although the depths are not labeled for clarity. Furthermore, in some embodiments, the groove depths of one or more grooves may not be equal.

In some embodiments, the geometry of the teeth and the grooves within each tooth/groove pair may be nominally equivalent apart from the height of one or more teeth being less than the depth of one or more corresponding grooves. Considering FIG. 19 for example, the first and second tooth heights 1941, 1951 are less than the corresponding groove depths. The first tooth height 1941 is less than the second tooth height 1951, which is subsequently less than the third tooth height 1961. However, the axial tooth spacings may equal the axial groove spacings; the tooth taper angles may equal the groove taper angles; the tooth outer taper angle may equal the groove outer taper angle; and the tooth leading angles may equal the groove front angles.

In some embodiments, the tooth height of each subsequent tooth may increase from the first tooth to the last tooth. Considering FIG. 19 for example, the first tooth height 1941 is less than the second tooth height 1951, which is subsequently less than the third tooth height 1961, while the third tooth height 1961 equals the groove depth. In some embodiments, the tooth height of each subsequent tooth may increase from the first tooth to an intermediate tooth having a tooth height that equals the groove depth, and each subsequent tooth after said intermediate tooth may also have a tooth height equal the groove depth. As a non-limiting example, a body having six teeth may be configured such that the first tooth may have the smallest tooth height and the tooth height may increase with each subsequent tooth, until the tooth heights of the fourth, fifth, and six teeth all equal the groove depths of the corresponding grooves.

A connecting assembly according to embodiments of the present disclosure may be used to connect two bodies together, where the connecting assembly and two bodies may collectively be referred to as the connection system. As discussed above, when the connecting assembly is assembled around and connected to a body being connected, the connecting assembly and the body may be coaxial, and thus share a central longitudinal axis. The central longitudinal axis may serve as a reference coordinate for measuring the tooth and groove profiles, as described herein.

A connection system according to embodiments of the present disclosure may include a connecting assembly for connecting a first body and a second body, where the first and second bodies have a plurality of grooves formed on an outside of the bodies near their connecting ends. The connecting assembly may include a connector having a plurality of connecting segments arranged circumferentially around a central longitudinal axis and a first jaw formed on an inside of the segments. The first jaw may include a plurality of teeth, each having a leading side facing an axial center of the connector, a top side, a trailing side opposite the leading side, and a tooth taper angle measured between a line tangent to the top side and a radial plane perpendicular to the central longitudinal axis, as described herein. The grooves in one or both of the bodies being connected may include a front side closest to the connecting end, a back side opposite the front side, a base side extending between the front side and the back side, an outer side extending between adjacent grooves and defining an outer diameter of the first body, and a groove taper angle measured between a line tangent to the outer side and the radial plane, as described herein. When the connector is connected to a body, the axially aligned teeth and grooves may be referred to as tooth/groove pairs, whereby each of the plurality of tooth/groove pairs engage when the first jaw interlocks with the first body.

In a connection system according to embodiments of the present disclosure, tooth spacing on a connector may match groove spacing of grooves formed in the body being connected. In some embodiments, the tooth leading angle may be different than a groove front angle in a corresponding groove, and/or the tooth taper angle may be different than the groove taper angle in a corresponding groove. The tooth taper angle for each tooth in a jaw of a connector may be the same, while the top side of at least one of the teeth in the jaw may be radially offset from the top side of at least one other of the plurality of the teeth. For example, the top side of two or more teeth may be radially offset when the teeth have different tooth heights.

Receiving profiles formed in bodies to be joined may have a variety of configurations, and may be the same or different from each other. For example, a receiving profile may include one or more spaced apart linear grooves, where the geometries of the grooves may be the same or different. In some embodiments, a receiving profile may include grooves that are equally spaced apart along its axial direction, and in some embodiments, a receiving profile may include multiple grooves having different axial separation distances. In some embodiments, a receiving profile may be axisymmetric around the body. A receiving profile may have any number of grooves (e.g., 1, 2, 3, 4, 5, 6, or more).

In some embodiments, both of two bodies to be connected have channels extending through the center of the bodies in an axial direction. Examples of bodies used in oil and gas that have channels are a pipe, wellhead, and tubing head. For instance, the connecting assembly described here may be used to connect two pipes together or to connect a pipe to a wellhead. Connecting two such bodies may provide a fluid connection between the channels of the bodies, which allows fluid to flow freely between them. In some embodiments, the fluid may flow within the two channels in either axial direction.

Furthermore, the channel of one or both bodies may not be a through channel, and instead the channel(s) may branch or end. A Christmas Tree is one example of this type of component that is used in oil and gas. Accordingly, in some embodiments, a connector may be used to connect a pipe or wellhead to a Christmas Tree.

In some embodiments, a connecting assembly described herein may be used to connect a body with a channel to one that lacks a channel. In such a case, the channel-less body may be an end cap or may serve some other purpose. For instance, a lower riser package or a blow-out preventer may be connected to a pipe or wellhead using a connecting assembly according to embodiments described herein. Furthermore, a connector may be used to attach a fluid channel to some other apparatus, such as a storage vessel or testing/processing equipment.

In some embodiments, a connecting assembly described herein may be used to connect two bodies that are both without a channel extending therethrough. A channel in either body is not necessary for deployment of a connection system according to embodiments of the present disclosure.

Further, bodies to be connected by a connecting assembly disclosed herein may have various shapes, including, for example, an overall generally cylindrical shape (e.g., a straight pipe), or a bent cylindrical shape (e.g., a pipe with one or more turns). In some embodiments, a body being connected may have an irregular shape with one or more cylindrically shaped ports, such as a manifold, or other type of block component having one or more cylindrically shaped outlets/inlets, where cylindrically shaped ports may be connected through a connecting assembly disclosed herein.

A process for performing the connection of a first and second body, according to one or more embodiments, may include connecting a connecting assembly described herein to a second body. The connecting assembly used may include a connector, a main piston, and any other component used to hold the connecting segments of the connector in a circumferential arrangement around the second body according to the one or more embodiments described herein. The connecting assembly may be attached to an axial end of the second body. In one or more embodiments, connecting the second body and connecting assembly may be performed off-site, for instance in a factory or in a centralized facility. Alternatively, this process may be performed immediately before the connection is made, at a location such as on an off-shore drilling platform or adjacent to the well site.

The connecting assembly may be unlocked by axially translating the main piston into the unlocked position. One embodiment of a connecting assembly in the unlocked configuration can be seen in FIG. 1. As described above, there are many potential axial locations for the main piston when it is in the unlocked position. In an unlocked configuration, the second end of the connector may be in a radially inward position such that the second locking profile is engaged with the second receiving profile of the second body to be connected, and the first end of the connector may be in a radially outward position. As above, in one or more embodiments, unlocking the connecting assembly may be performed off-site, for instance in a factory or in a centralized facility. Alternatively, this process may be performed immediately before the connection is made, at a location such as on an off-shore drilling platform or adjacent to the well site.

To connect a second body to a first body, an axial end of the second body may be positioned so that it interfaces with an axial end of the first body. Additionally, the second receiving profile may be radially aligned with the first receiving profile, and a first end of the connector may be radially outside the axial end of the first body. In some embodiments, a first locking profile formed in the first end of the connector may be radially outside a first receiving profile formed in the axial end of the first body. Furthermore, in such a configuration, the channels of the first and second bodies may also be aligned and coaxial.

In some embodiments, a first body may be essentially stationary while a second body and pre-connected connecting assembly may be relatively mobile. The first body may be capable of small movements due to the environment (e.g., waves, currents, geological motion, equipment vibration), but not substantial movement to intentionally alter its position in preparation for connection. In such a configuration, the second body and pre-connected connecting assembly may be maneuvered into place so they are positioned axially in line with the stationary first body.

One embodiment of this situation may include connecting a new component (second body) to a component that is already in a well line (first body). In such a system, the first body may either be the well line or a component already connected to the wellhead, in some embodiments. In contrast, the second body, in some embodiments of such a system, may be a new, unattached component. Accordingly, the second body and a pre-connected connecting assembly as described herein may be maneuvered into place, axially in-line with the first body, in order to connect the new component to the existing component of a well line.

Converting the system from the unlocked configuration to the locked configuration may include translating a main piston in the connecting assembly axially from an unlocked position to a locked position. This movement ultimately causes an axial end of the connector to move radially inward. In some embodiments, there may be one or more intermediate components that transfer the axial movement of the main piston into inward radial movement of the axial end of the connector.

Capturing a first receiving profile with a first locking profile may occur when an axially central part of the first locking profile successfully passes the outermost edge of first receiving profile. A successful capture may be one which results in both locking profiles of the connector fully interlocked with both receiving profiles of the two bodies being connected. Successful captures may further be ones where a clash between the edges of the teeth and corresponding grooves is successfully avoided. The tooth closest to the axial center of a connector may be the part of the locking profile that initially engages with the corresponding receiving profile, according to some embodiments.

In the locked configuration, the connecting assembly may prevent the connected first and second bodies from moving apart. In this configuration, the main piston is in the locked position, which keeps both the first and second axial ends of the connector in the radially inward positions. In such a position, the first locking profile is interlocked with the first receiving profile and the second locking profile is interlocked with the second receiving profile. In some embodiments, there may be one or more intermediate components between the main piston and the connector (at either or both axial ends) that directly keep the first and second axial ends of the connector in the radially inward positions.

When a first body is not connected, the main piston may be moved between the locked position and the unlocked position. However, in some embodiments, when the connecting assembly is engaged with both a first body and a second body, it may be possible to secure the main piston such that the main piston cannot readily move from the locked position to the unlocked position. In such a system, it may be unnecessary to continuously apply force on the main piston to keep it from axially moving out of the locked position. Therefore, in some embodiments, it may be unnecessary to constantly maintain force, such as can be exerted by hydraulic pressure, to keep the connecting assembly in the locked configuration. In some embodiments, axially translating the main piston to the locked position may also secure it. Alternatively, in some embodiments, securing the main piston may include additional steps in addition to the axial translation of the main piston into the locked position. In any case, there are clear advantages to a system where, once locked, the main piston in a connecting system does not need continuous external input to stay locked, particularly for remote applications like subsea drilling.

In some embodiments, the axial movements of the main piston may be controlled with hydraulic actuators. Accordingly, in some embodiments of the method, actuation of hydraulic actuators may produce the necessary axial movements of the main piston. In some embodiments, mechanical means may be used to axially move the main piston in a connecting assembly.

In some embodiments, the teeth of a first locking profile may engage sequentially with the opposite grooves of a first receiving profile. Sequential engagement may include the tooth closest to the axial center of the connector engaging first with a first groove, followed by the second closest tooth engaging with the second groove, followed by the third closest tooth engaging with the third groove, and so on. Engagement continues, sequentially, until the first locking profile is fully interlocked with the first receiving profile. Alternatively, all the teeth of the first locking profile may engage with the opposite grooves at nominally the same time. In some embodiments, engagement may occur in a reverse sequential order, starting with the last tooth and progressing in reverse order towards the axial midline. Finally, in some embodiments, engagement may occur in another order, for example an order with a recognizable pattern (e.g., 1, 5, 2, 4, 3 or 5, 3, 1, 4, 2) or a random order (e.g., 1, 4, 3, 2, 5 or 2, 5, 4, 1, 3).

Other examples of connecting assembly components having different sizes, shapes, number of teeth, tooth leading angles and taper angles, types of hydraulic actuators, locking systems, etc. as disclosed herein may be used in combination to improve the performance and mechanical advantage of the connecting assembly.

As used herein, mechanical advantage is the ratio of the generated connector preload and the external applied force. When the connecting assembly is hydraulically operated, the higher the required applied force, the higher the hydraulic pressure is required. The force required to generate a given preload may be decreased by increasing the mechanical advantage.

Generally, a higher mechanical advantage may be achieved by having a shallower tooth leading angle, which may transmit more axial force and less radial force. The downside of this design is that it may be harder to interface the tooth with a corresponding groove due to the shallower angle, thereby making the capture of the locking profile more difficult during the locking procedure.

By successfully interfacing with a high mechanical advantage design, a connecting assembly may require less hydraulic pressure to operate and therefore the size, weight, and cost of the connecting assembly can be reduced.

The present disclosure describes a design for the teeth in a connecting assembly that may provide easier capture of the connecting assembly, particularly for connecting assemblies with a low profile, a high preload, and a high gasket separation. Such connecting assemblies can be smaller, lighter, and thus less costly for a given performance requirement.

Embodiments of the present disclosure may provide a connecting assembly, notedly for connecting components to a wellhead in oil production and extraction operations, particularly in the seabed, solving advantageously the technical inconvenient and economic disadvantages indicated above.

The figures described herein, and particularly FIGS. 9-15, are depicted schematically and are not drawn to scale. In fact, in order to more clearly highlight the feature(s) of interest, some of the figures may schematically depict embodiments with exaggerated measurements, such as in the depictions of relative length and/or angle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A connecting assembly for connecting a first body and a second body, the first body comprising a plurality of grooves formed on an outside of the first body near a connecting end, the connecting assembly comprising:

a connector, comprising:

a plurality of connecting segments arranged circumferentially around a central longitudinal axis; and a first jaw formed on an inside of the segments, the first jaw comprising a plurality of teeth, wherein each tooth comprises:

a leading side facing an axial center of the connector;

a top side; and a trailing side opposite the leading side;

wherein a tooth height is measured between a base of the tooth and an intersection between the leading side and the top side of the tooth, wherein each groove comprises:

a front side closest to the connecting end;

a back side opposite the front side;

a base side extending between the front side and the back side; and an outer side extending between adjacent grooves;

wherein a groove depth is measured between a line tangent to the outer side and an intersection between the front side and the base side of the groove, wherein a plurality of tooth/groove pairs each comprise one of the plurality of teeth and one of the plurality of grooves that axially correspond whereby each of the plurality of tooth/groove pairs engage when the first jaw interlocks with the first body, and wherein at least two of the tooth/groove pairs have a difference between tooth height and groove depth that are different from each other.

2. The connecting assembly according to claim 1, wherein the tooth height of at least one of the plurality of the teeth is different than the tooth height of at least one other of the plurality of the teeth so the plurality of teeth are not colinear.

3. The connecting assembly according to claim 1, wherein, within at least one of the plurality of tooth/groove pairs in the first jaw, the tooth height of at least one of the plurality of the teeth is greater than a groove depth of at least one of the plurality of the grooves.

4. The connecting assembly according to claim 1,
wherein a tooth taper angle is measured between a line tangent to the top side and a radial plane perpendicular to the central longitudinal axis, wherein the tooth taper angle for each of the plurality of teeth is the same,
wherein a groove taper angle is measured between a line tangent to the outer side and the radial plane, and
wherein the groove taper angle is different than the tooth taper angle.

5. The connecting assembly according to claim 4, wherein the groove taper angle is greater than the tooth taper angle.

6. The connecting assembly according to claim 4, wherein the groove taper angle is less than the tooth taper angle.

7. The connecting assembly according to claim 1,
wherein a tooth taper angle is measured between a line tangent to the top side and a radial plane perpendicular to the central longitudinal axis, wherein the tooth taper angle for each of the plurality of teeth is the same,
wherein a groove taper angle is measured between a line tangent to the outer side and the radial plane, and
wherein the groove taper angle is equal to the tooth taper angle.

8. The connecting assembly according to claim 1, wherein the connector further comprises a second jaw comprising a plurality of teeth formed on an inside of the segments axially separated from the first jaw, wherein the second jaw has a second locking profile that corresponds in shape with a second receiving profile on an outside of the second body.

9. The connecting assembly according to claim 8, the connecting assembly further comprising a main piston positioned around at least a portion of the connector;
wherein, when the main piston is in an unlocked position, at least one of the first or second ends of the connector is in a disconnected position, and
wherein, when the main piston is in a locked position, both the first end and the second end of the connector are in a connected position.

10. The connecting assembly of claim 1, wherein the first body is a wellhead.

11. The connecting assembly of claim 1, wherein a tooth spacing between each of the plurality of teeth is equivalent to a groove spacing between each of the plurality of grooves.

12. A connecting assembly for connecting a first body and a second body, the first body comprising a plurality of grooves formed on an outside of the first body near a connecting end, each groove having a front side closest to the connecting end, a base side, and a back side opposite the front side, the connecting assembly comprising:
a connector, comprising
a central longitudinal axis extending lengthwise through a center of the connector; and
a first jaw formed on an inside of the connector near a first axial end of the connector, the first jaw comprising:
a plurality of teeth, each tooth having a leading side facing an axial center of the connector, a top side, and a trailing side opposite the leading side;
wherein a tooth leading angle is measured between a line tangent to the leading side and a radial plane perpendicular to the central longitudinal axis,
wherein a groove front angle is measured between a line tangent to the front side and the radial plane, and
wherein the tooth leading angle is different than the groove front angle,
wherein a tooth height of at least one of the plurality of the teeth is different than at least the tooth height of at least one other of the plurality of the teeth so the plurality of teeth are not colinear.

13. The connecting assembly according to claim 12, wherein the groove front angle is greater than the tooth leading angle.

14. The connecting assembly of claim 12, wherein a tooth spacing between each of the plurality of teeth is equivalent to a groove spacing between each of the plurality of grooves.

15. The connecting assembly of claim 12, wherein a tooth height of at least one of the plurality of teeth in the first jaw is less than a groove depth of the groove in a tooth/groove pair.

16. A connecting assembly for connecting a first body and a second body, the first body comprising a plurality of grooves formed on an outside of the first body near a connecting end, the connecting assembly comprising:
a connector, comprising:
a plurality of connecting segments arranged circumferentially around a central longitudinal axis; and
a first jaw formed on an inside of the segments, the first jaw comprising a plurality of teeth, wherein each tooth comprises:
a leading side facing an axial center of the connector;
a top side; and
a trailing side opposite the leading side;
wherein a tooth taper angle is measured between a line tangent to the top side and a radial plane perpendicular to the central longitudinal axis,
wherein each groove comprises:
a front side closest to the connecting end;
a back side opposite the front side;
a base side extending between the front side and the back side; and
an outer side extending between adjacent grooves;
wherein a groove taper angle is measured between a line tangent to the outer side and the radial plane,
wherein the tooth taper angle is different than the groove taper angle,
wherein a tooth height of at least one of the plurality of the teeth is different than at least the tooth height of at least one other of the plurality of the teeth so the plurality of teeth are not colinear.

17. The connecting assembly of claim 16, wherein a tooth spacing between each of the plurality of teeth is equivalent to a groove spacing between each of the plurality of grooves.

18. The connecting assembly of claim 16, wherein a tooth height of at least one of the plurality of teeth in the first jaw is less than a groove depth of the groove in a tooth/groove pair.

* * * * *